US008033753B2

(12) United States Patent
Waters, Jr.

(10) Patent No.: US 8,033,753 B2
(45) Date of Patent: Oct. 11, 2011

(54) AUTOMATIC FLOODING PROTECTION FOR UNDERGROUND VENTILATION DUCTS

(75) Inventor: Louis A. Waters, Jr., Bellaire, TX (US)

(73) Assignee: Floodbreak, L.L.C., Houston, TX (US)

( * ) Notice: Subject to any disclaimer, the term of this patent is extended or adjusted under 35 U.S.C. 154(b) by 385 days.

(21) Appl. No.: 12/321,263

(22) Filed: Jan. 16, 2009

(65) Prior Publication Data

US 2009/0185864 A1 Jul. 23, 2009

Related U.S. Application Data

(60) Provisional application No. 61/011,690, filed on Jan. 18, 2008.

(51) Int. Cl.
*E02B 7/20* (2006.01)

(52) U.S. Cl. ..... 405/96; 405/87; 405/92; 405/100

(58) Field of Classification Search ..... 405/87, 405/90, 92, 94, 96, 98, 99, 100
See application file for complete search history.

(56) References Cited

U.S. PATENT DOCUMENTS

| | | | | |
|---|---|---|---|---|
| 2,459,140 | A | 1/1949 | Arne | |
| 3,015,342 | A | 1/1962 | Price | |
| 3,111,078 | A | 11/1963 | Breckenridge | |
| 4,832,527 | A * | 5/1989 | Bachmann | 405/105 |
| 6,623,209 | B1 | 9/2003 | Waters, Jr. | |
| 7,101,114 | B1 | 9/2006 | Waters, Jr. | |
| 7,234,894 | B1 * | 6/2007 | Flury | 405/94 |
| 7,270,498 | B1 * | 9/2007 | Albanese | 405/104 |

FOREIGN PATENT DOCUMENTS

| | | |
|---|---|---|
| GB | 2371324 A | 7/2002 |
| GB | 2371584 A | 7/2002 |

* cited by examiner

*Primary Examiner* — David Bagnell
*Assistant Examiner* — Benjamin Fiorello
(74) *Attorney, Agent, or Firm* — Tim L. Burgess

(57) ABSTRACT

Embodiments are described for preventing downward flow of substantial surface water into an underground ventilation duct communicating upwardly to a ground surface opening. The embodiments comprise a support having a top opening and an opening in a lower portion above a floor. The opening in the lower portion is for venting communication with a proximate portion of the ventilation duct. The support supports at least one seat and paired buoyant gate set. The seat is mounted perpendicularly relative to the gate and a portion of a passageway under the seat for fluidly communicating beyond such portion to the top opening of the support and to the proximate portion of the ventilation duct. The buoyant gate is positioned lower than the seat and the passageway, is of sufficient size to block the passageway, and is responsive to water rising in the support by floatingly pivoting upwardly until engaging the seat, thereby blocking the passageway. In an embodiment, the seat of at least one set is mounted under the top opening spaced from one of the opposing sides a horizontal distance nominally equal to a fraction applied to a length for the particular opening, the fraction having the numerator 1 and a denominator which is the sum of 1 plus the number of seat and gate sets, and the buoyant gate has a seat engagement height nominally equal to the same fraction applied to the same opening length.

53 Claims, 29 Drawing Sheets

AUTOMATIC FLOODING PROTECTION FOR UNDERGROUND VENTILATION DUCTS

CROSS-REFERENCE TO RELATED APPLICATIONS

This application claims priority to U.S. provisional application 61/011,690, filed Jan. 18, 2008, the entirety of the contents of which are incorporated herein by reference.

BACKGROUND OF THE DISCLOSURE

1. Technical Field

This invention relates to fluid control by water gates and more particularly, to pivoted gates responsive to water pressure.

2. Background Art

Prior patents by the present invent or have addressed preventing surface storm waters from entering and flooding lower levels of buildings or underground garages (U.S. Pat. No. 6,623,209) and preventing storm waters from storm sewers back flowing through street gutters into surface streets (U.S. Pat. No. 7,101,114). These inventions do not address the problem of surface storm waters entering and flooding underground tunnels and chambers through ventilation ducts connecting the underground chambers or tunnels to air at ground surface. Such chambers and tunnels include, without limitation, underground transportation tunnels for road vehicles, trains, and subways, and underground chambers, such as associated with a complex of connecting tunnels and shafts, for example as used for such things as underground hydroelectric-power plants, or with underground utilities which require ventilation, such as underground transformer rooms. In the case of subway systems, solutions have been suggested for reducing entrance of runoff water from street level grate openings through the ventilation ducts down into the underground systems, such as raising the subway grates above sidewalk level, but these are often not only costly to implement for each sidewalk grating area but also largely impracticable because much of the available sidewalk area available for pedestrians, already at a premium, is sacrificed to the solution.

The remaining drawings are advantageously viewed in sets of them. The term "figure" is customarily abbreviated to "Fig." For clarity in reference to figure numbers, sets are numbered according to the numbers identifying figures in a set; accordingly, there is no Fig. Set 1.

Figure 2:
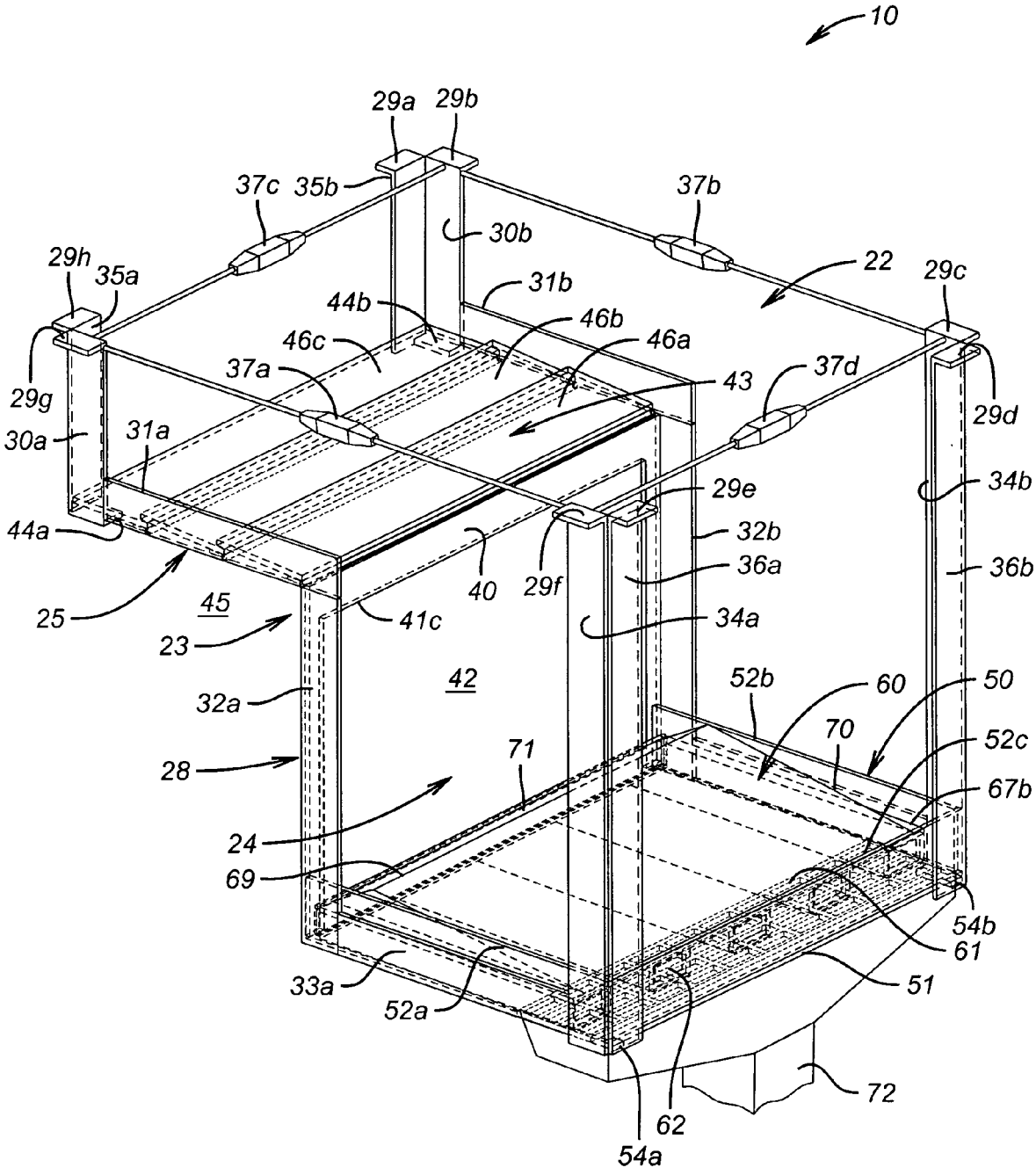
Figure 2A:
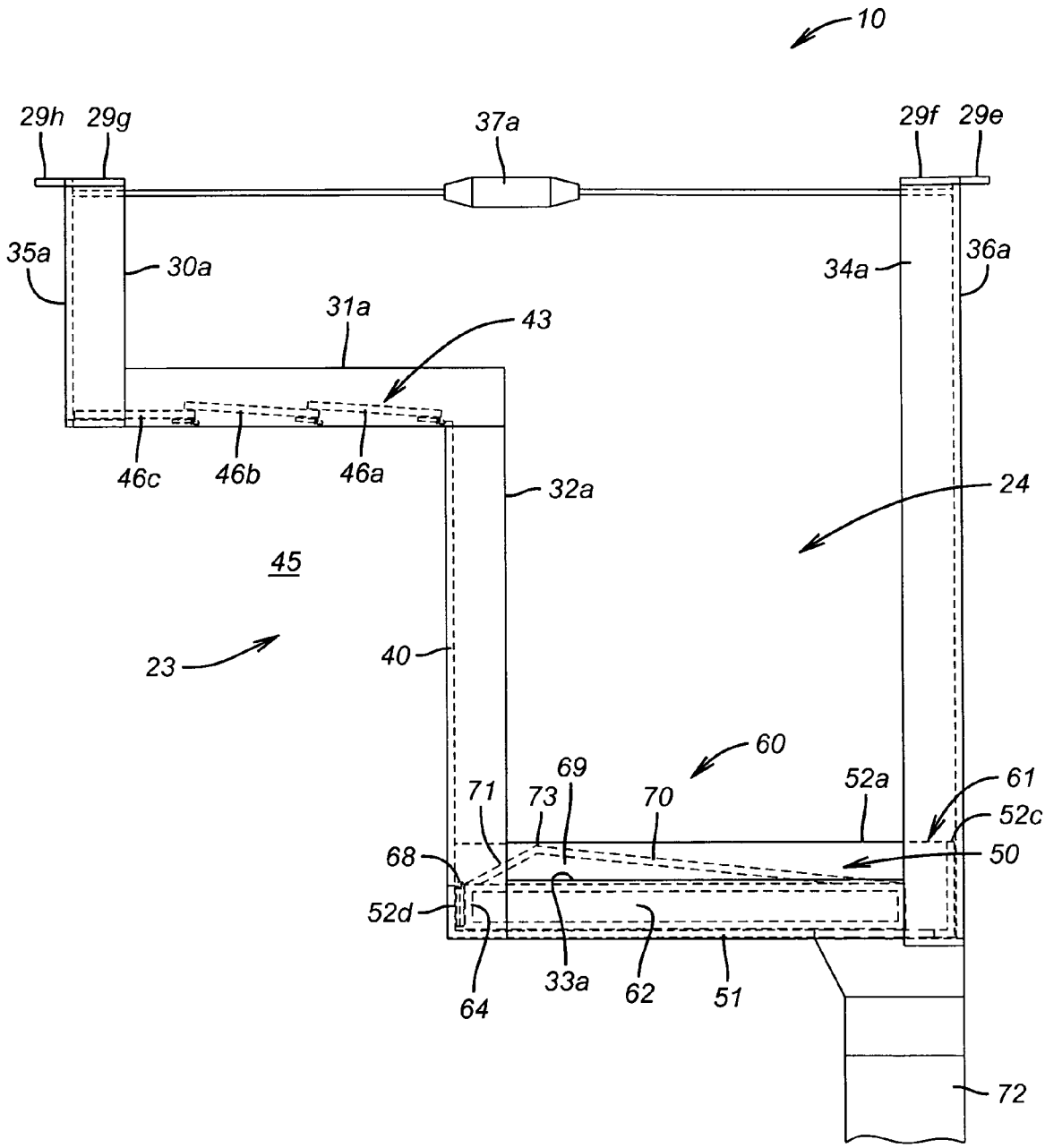
Figure 2B:
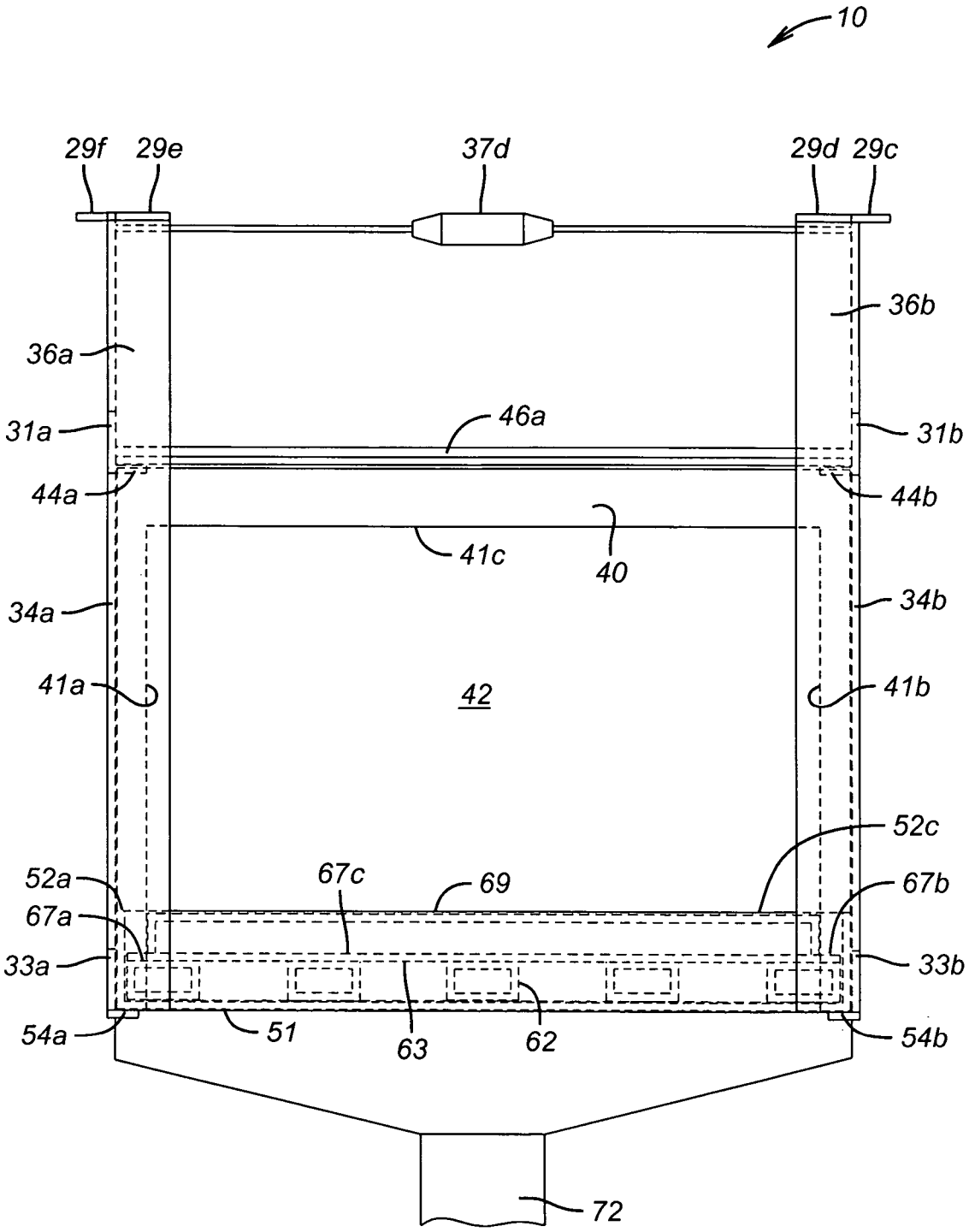

FIGS. 2, 2*a* and 2*b* comprise Fig. Set 2. FIG. 2*a* is an isometric view of one embodiment of a ventilation duct flood guard apparatus in accordance with this invention, using a single seat and buoyant gate set and illustrating the buoyant gate un-elevated, in horizontal position. FIG. 2*a* is an orthogonal side view and FIG. 2*b* is an orthogonal end view from the end that is on the viewer's right in FIG. 2.

Figure 3:
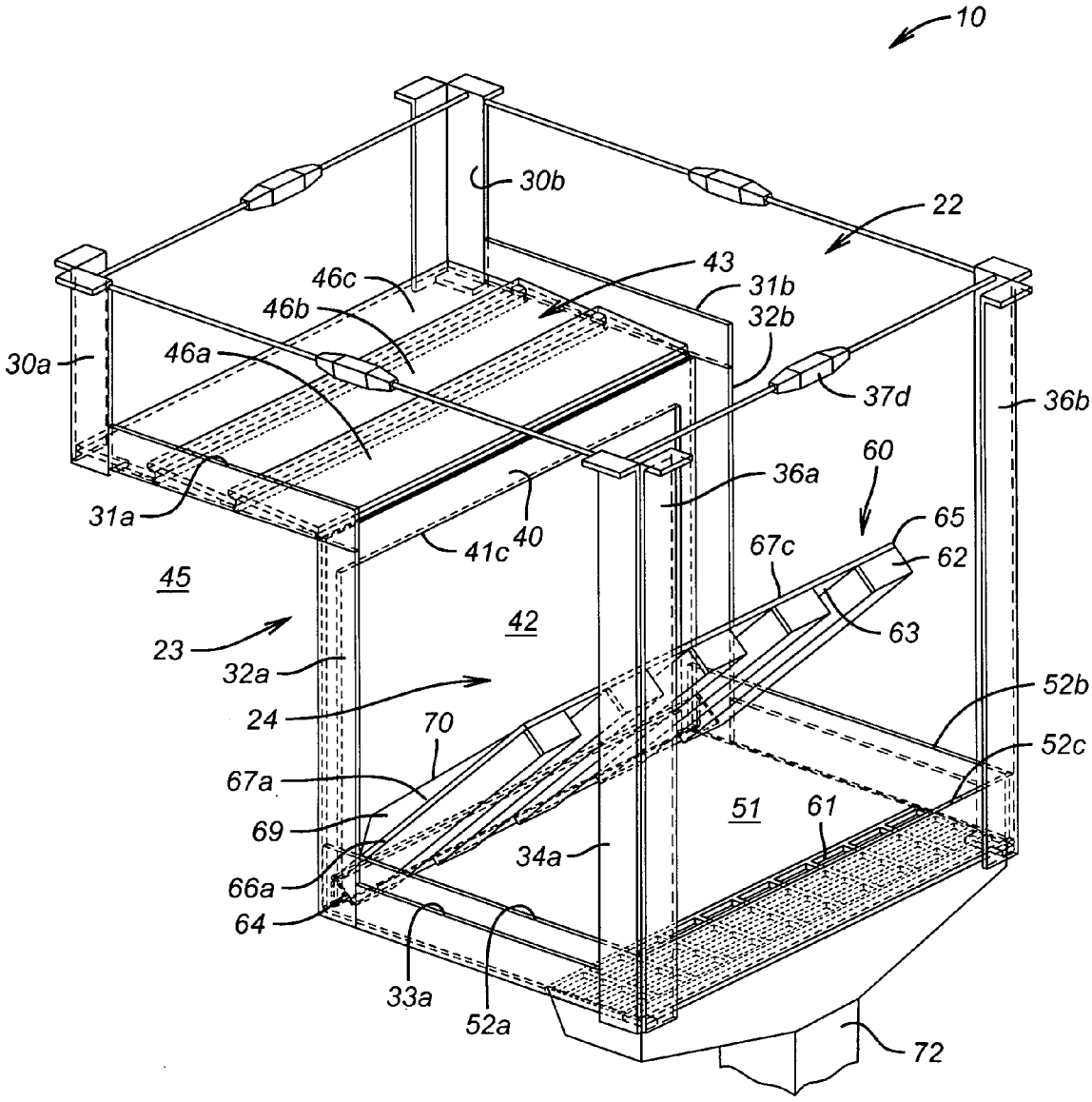
Figure 3A:
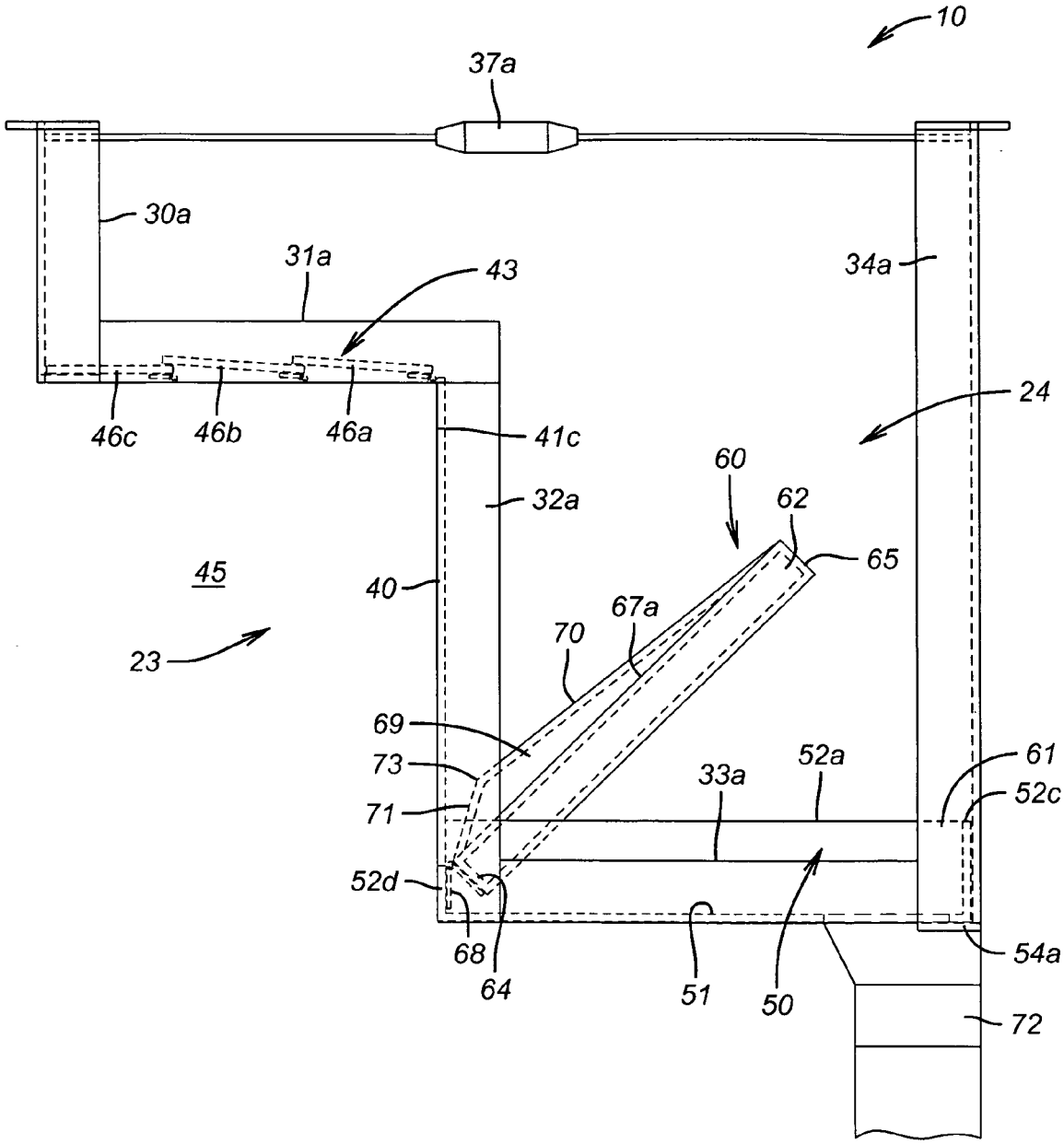
Figure 3B:
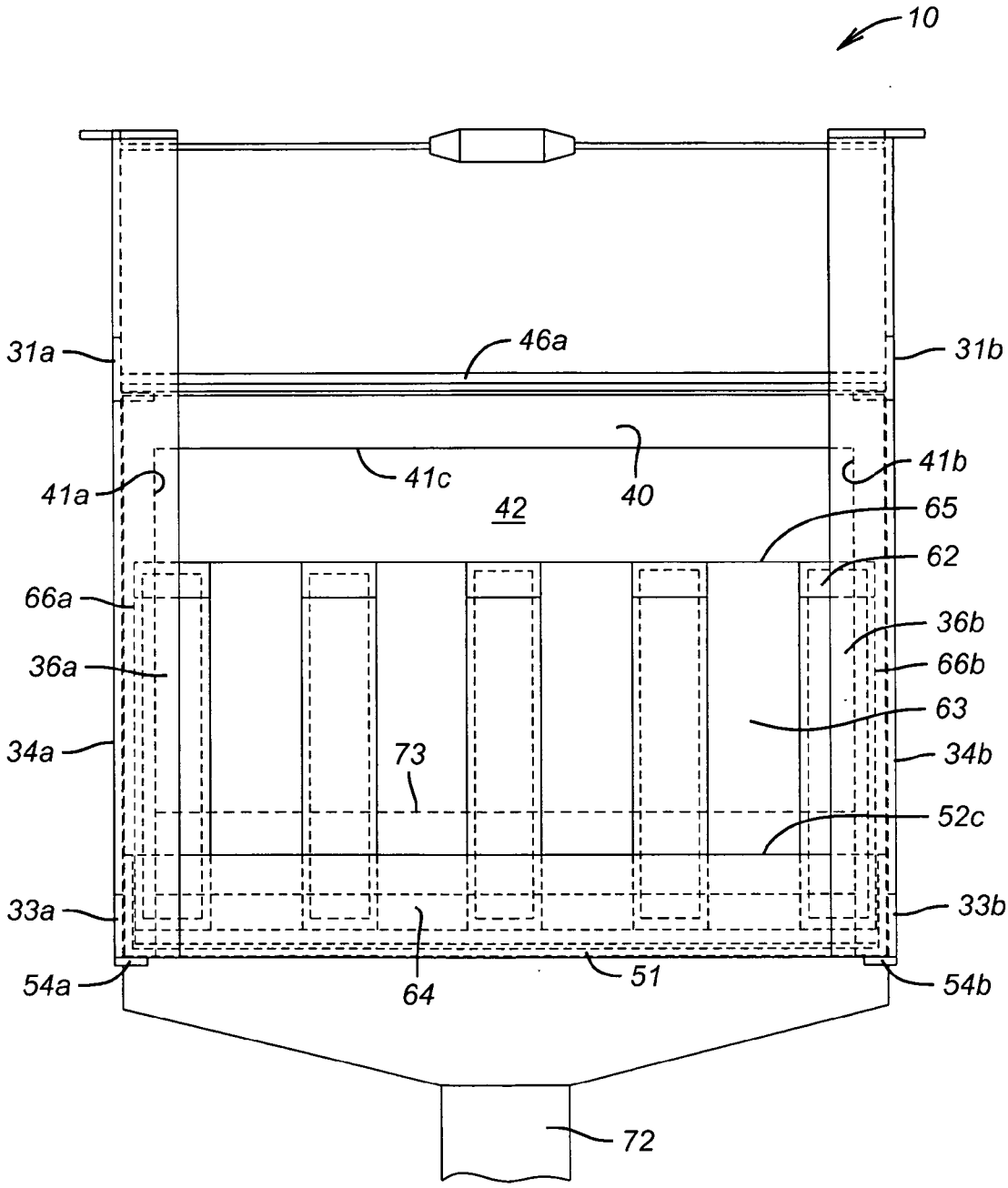

FIGS. 3, 3*a* and 3*b* comprise Fig. Set 3. FIG. 3 is an isometric view of the same ventilation duct flood guard apparatus as Fig. Set 2, illustrating the buoyant door in mid-lift. FIG. 3*a* is an orthogonal side view and FIG. 3*b* is an orthogonal end view from the end that is on the viewer's right in FIG. 3.

Figure 4:
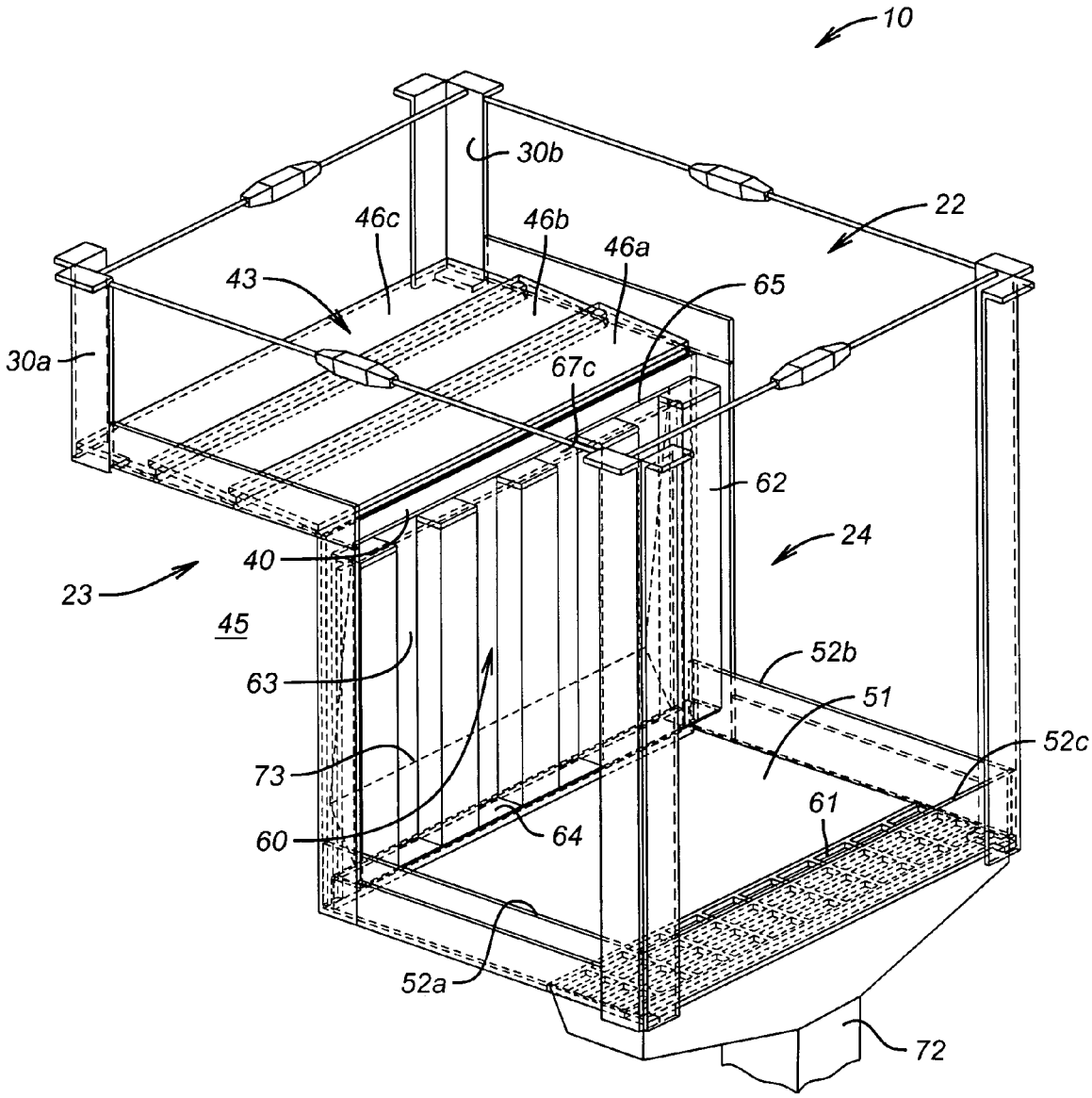
Figure 4A:
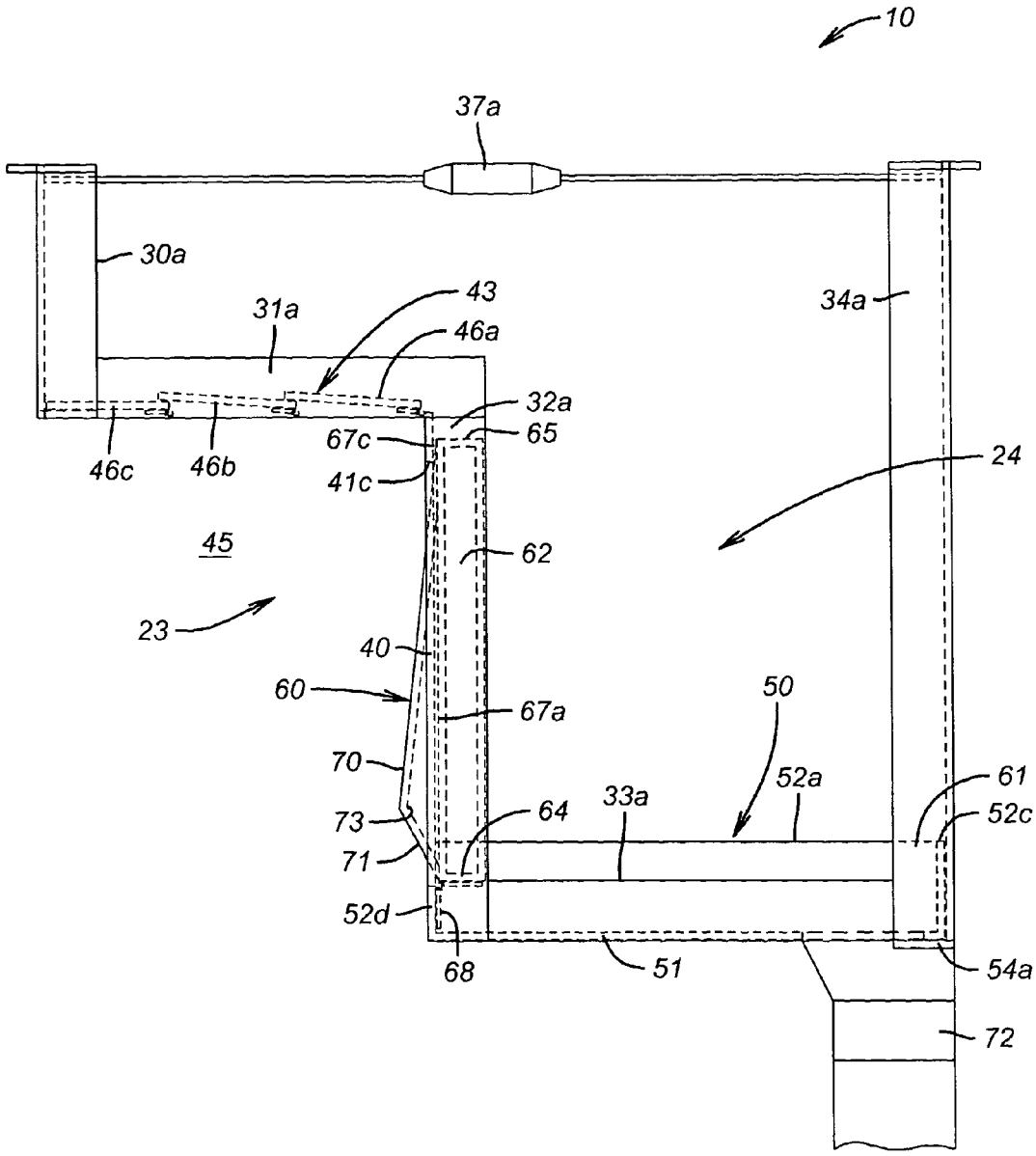
Figure 4B:
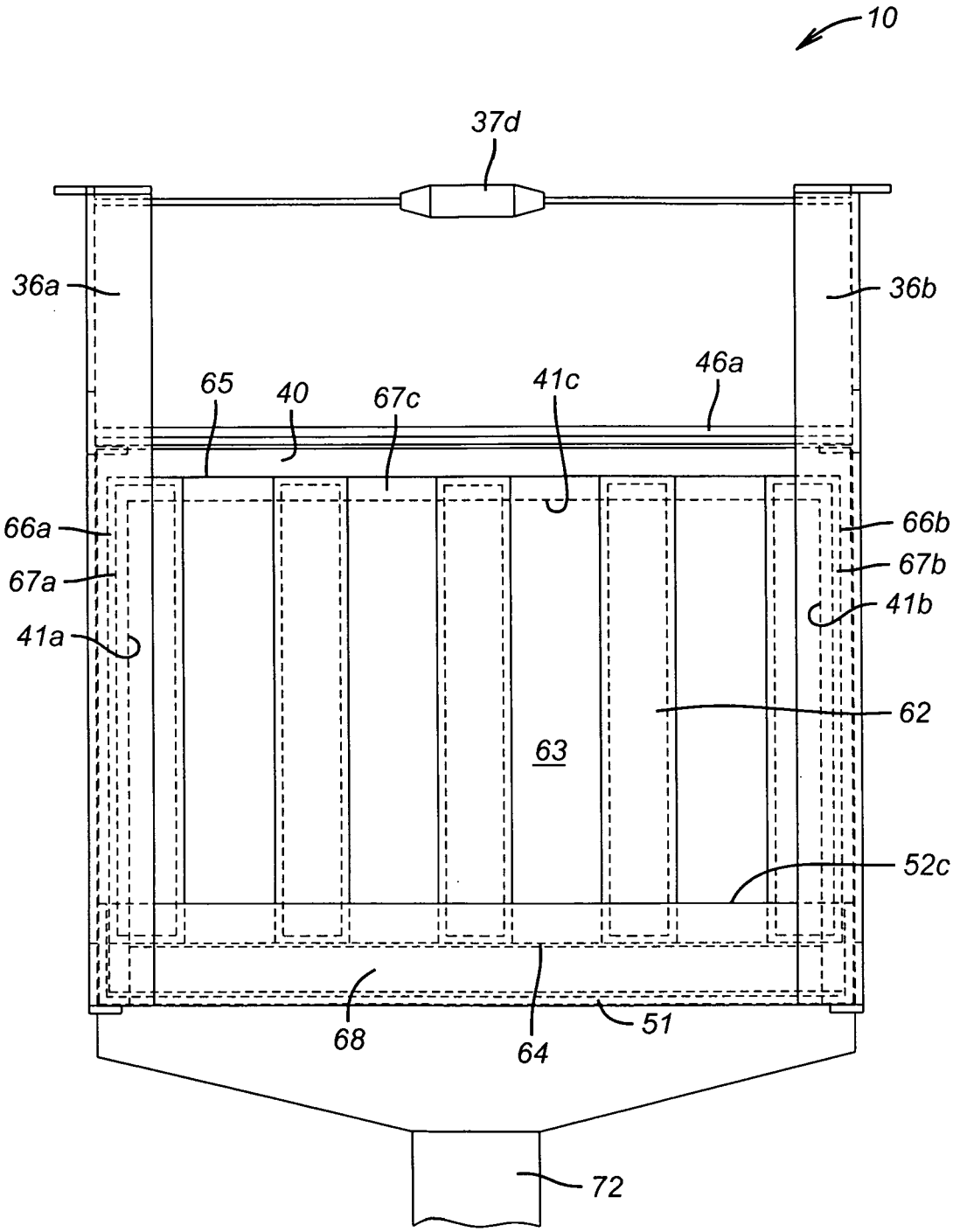

FIGS. 4, 4*a* and 4*b* comprise Fig. Set 4. FIG. 4 is an isometric view of the same ventilation duct flood guard apparatus as Fig. Set 2, with the buoyant door depicted in fully raised position for obstructing entry of flood into the ventilation duct. FIG. 4*a* is an orthogonal side view and FIG. 4*b* is an orthogonal end view from the end that is on the viewer's right in FIG. 4.

Figure 5:
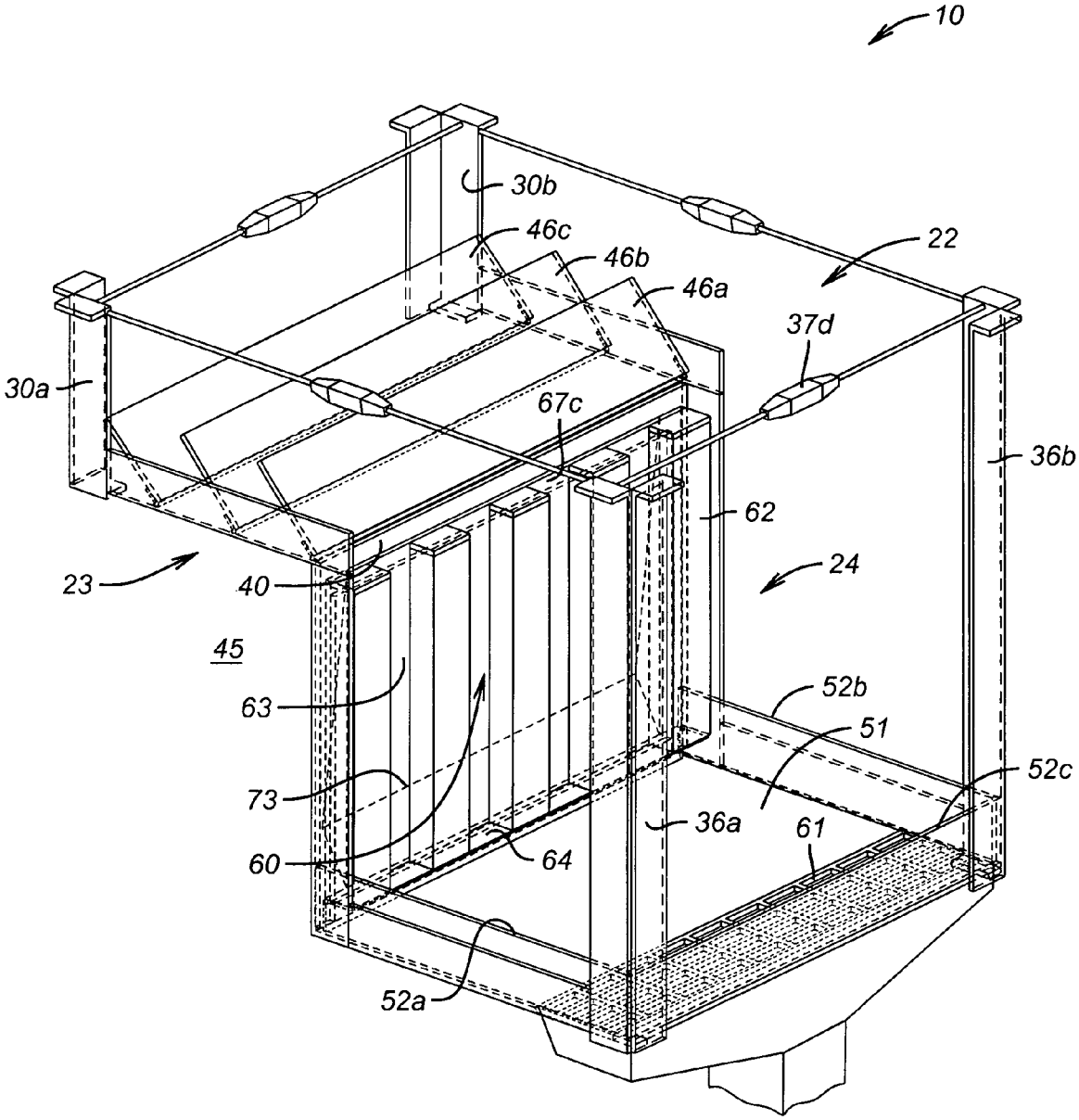
Figure 5A:
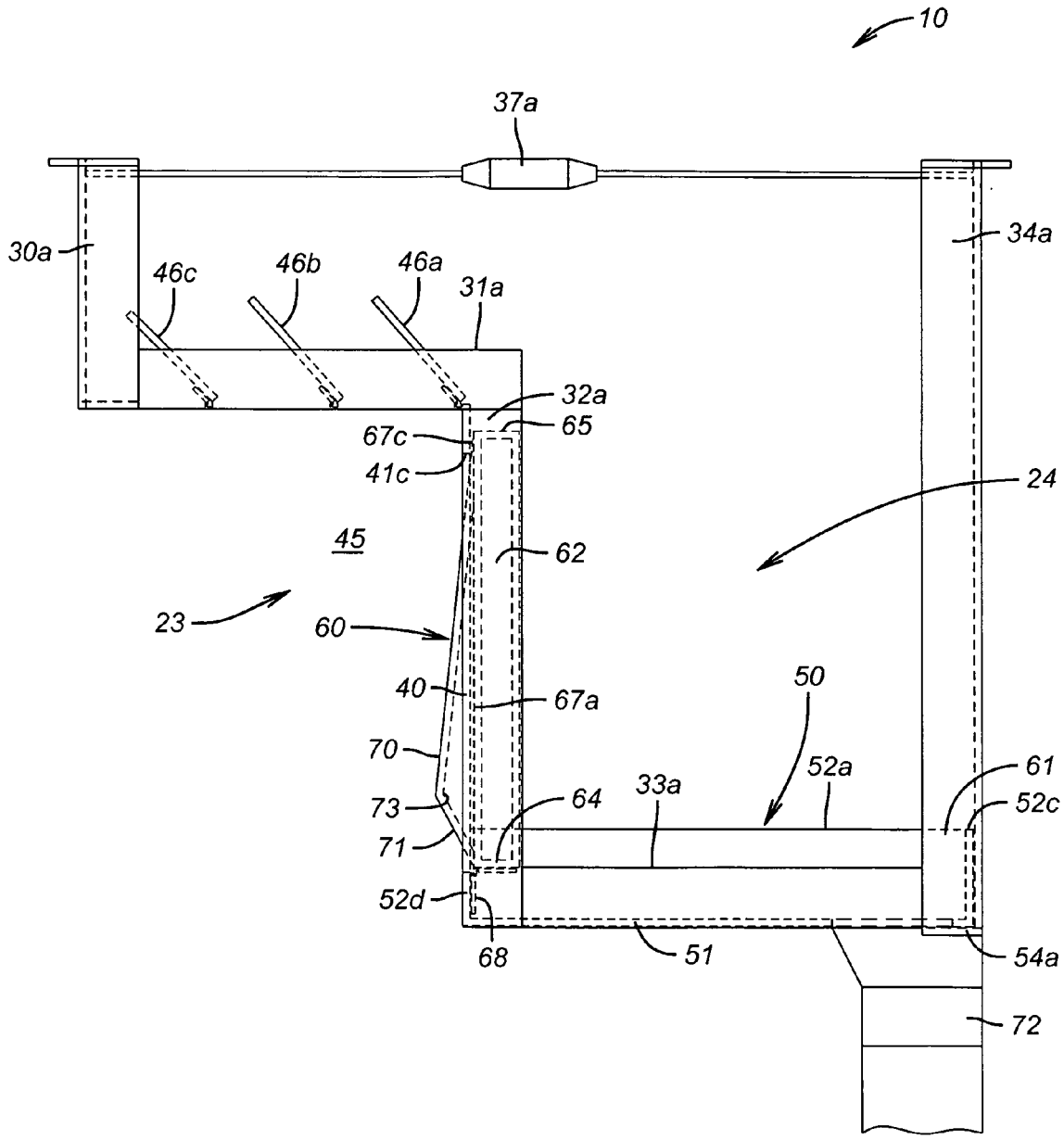
Figure 5B:
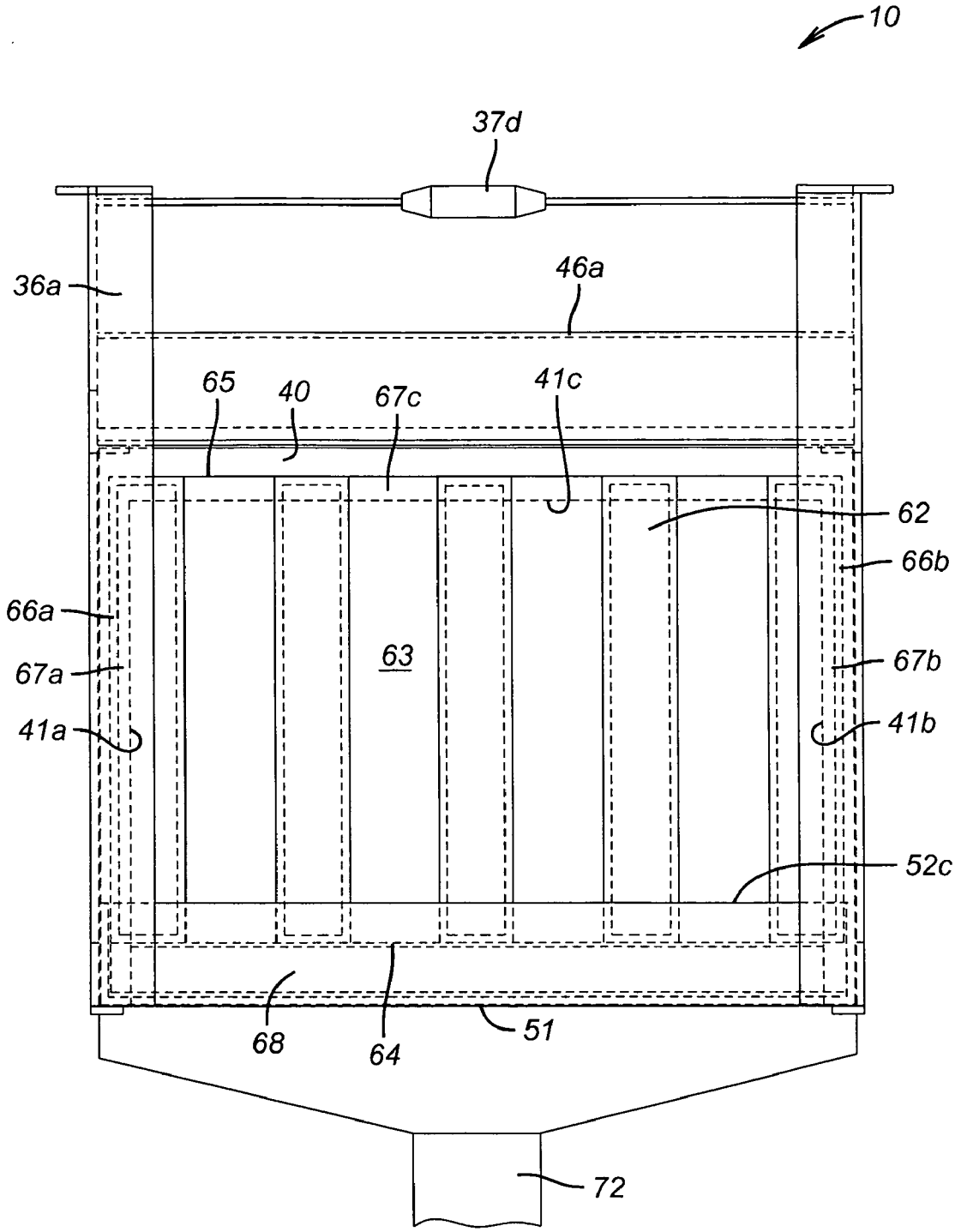

FIGS. 5, 5*a* and 5*b* comprise Fig. Set 5. FIG. 5 is an isometric view of the same ventilation duct flood guard apparatus as Fig. Set 2, with the buoyant door depicted in fully raised position as in Fig. Set 4, and depicts venting shutters in partial lift. FIG. 5*a* is an orthogonal side view and FIG. 5*b* is an orthogonal end view from the end that is on the viewer's right in FIG. 5.

Figure 6:
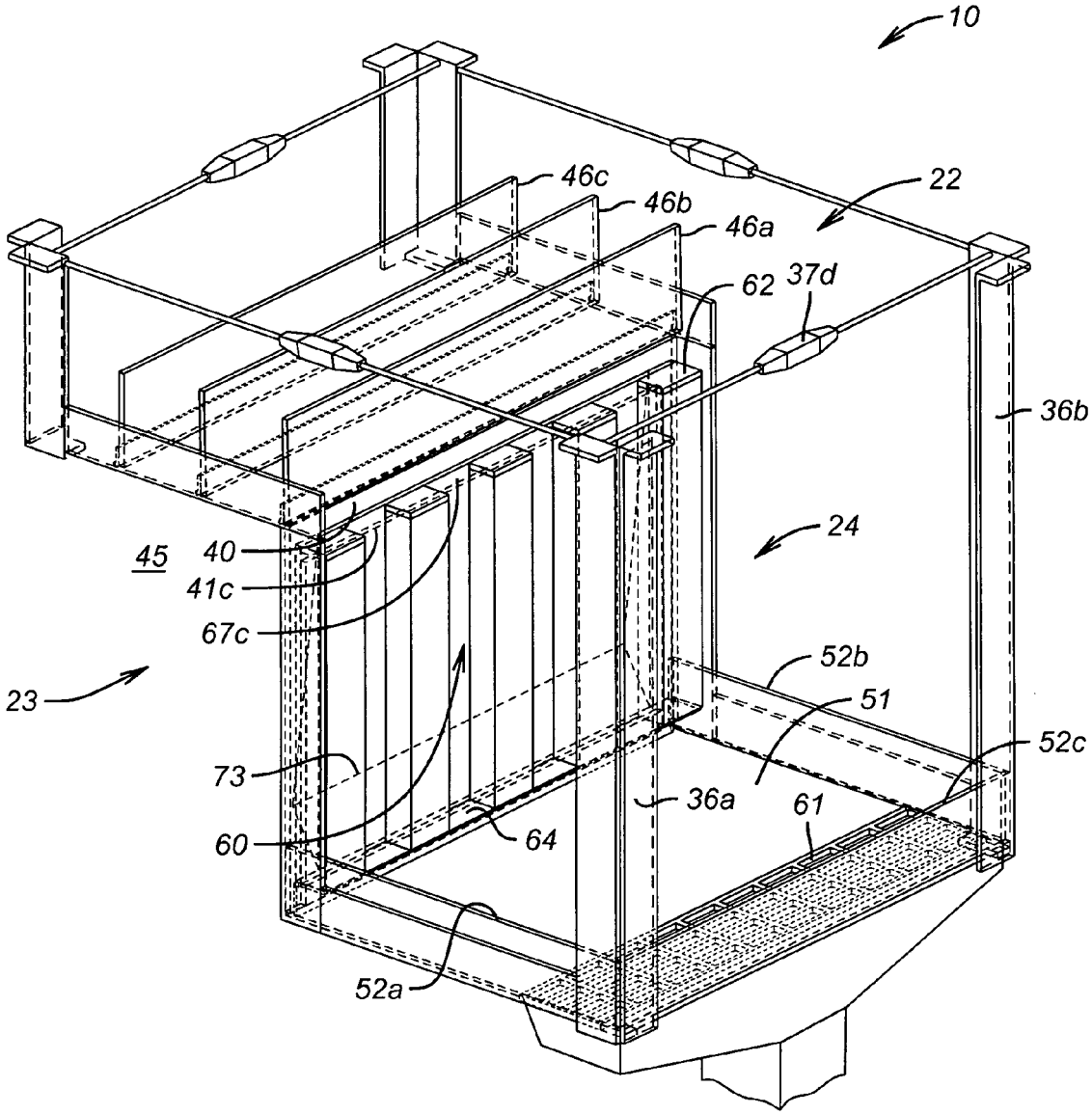
Figure 6A:
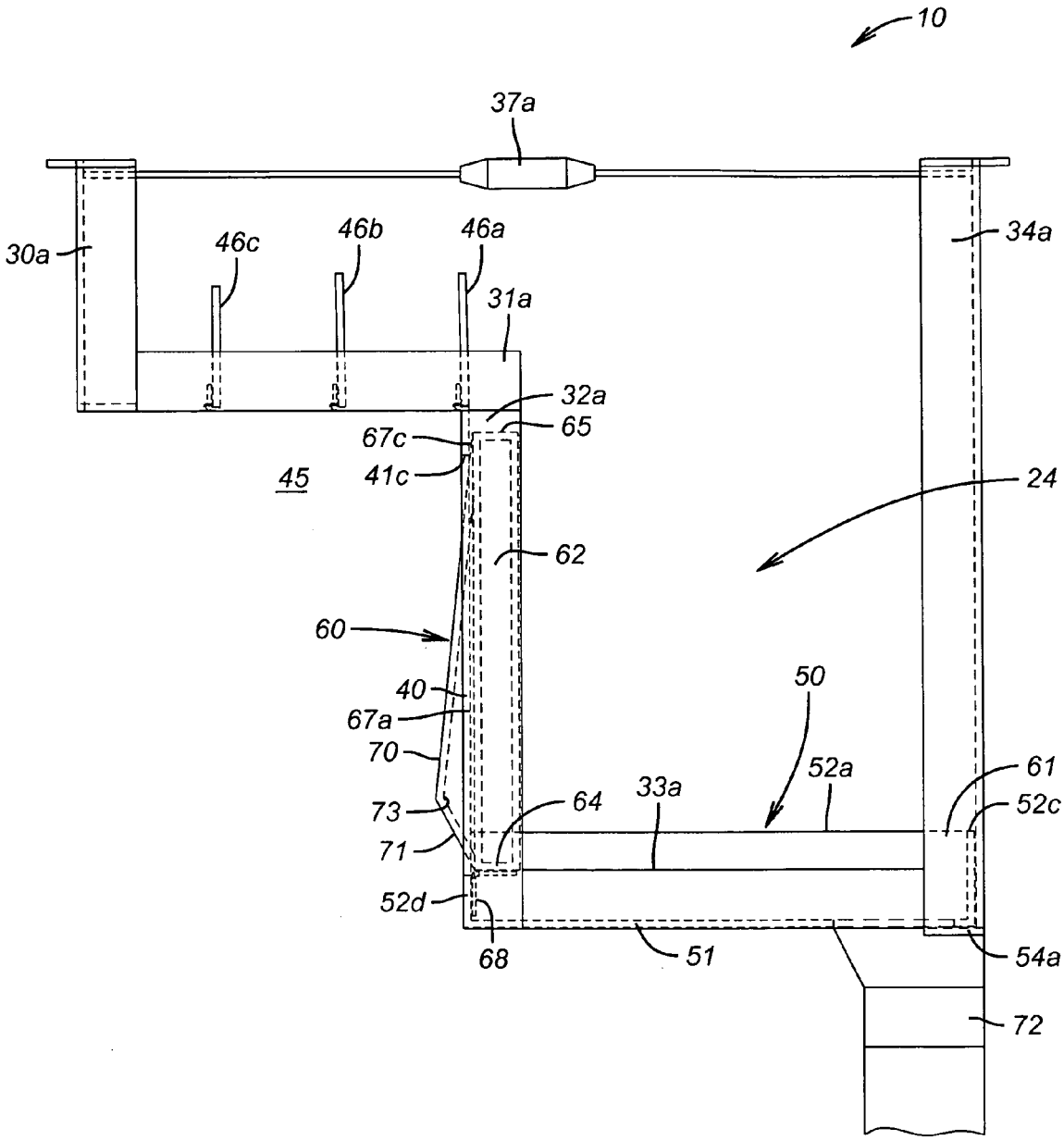
Figure 6B:
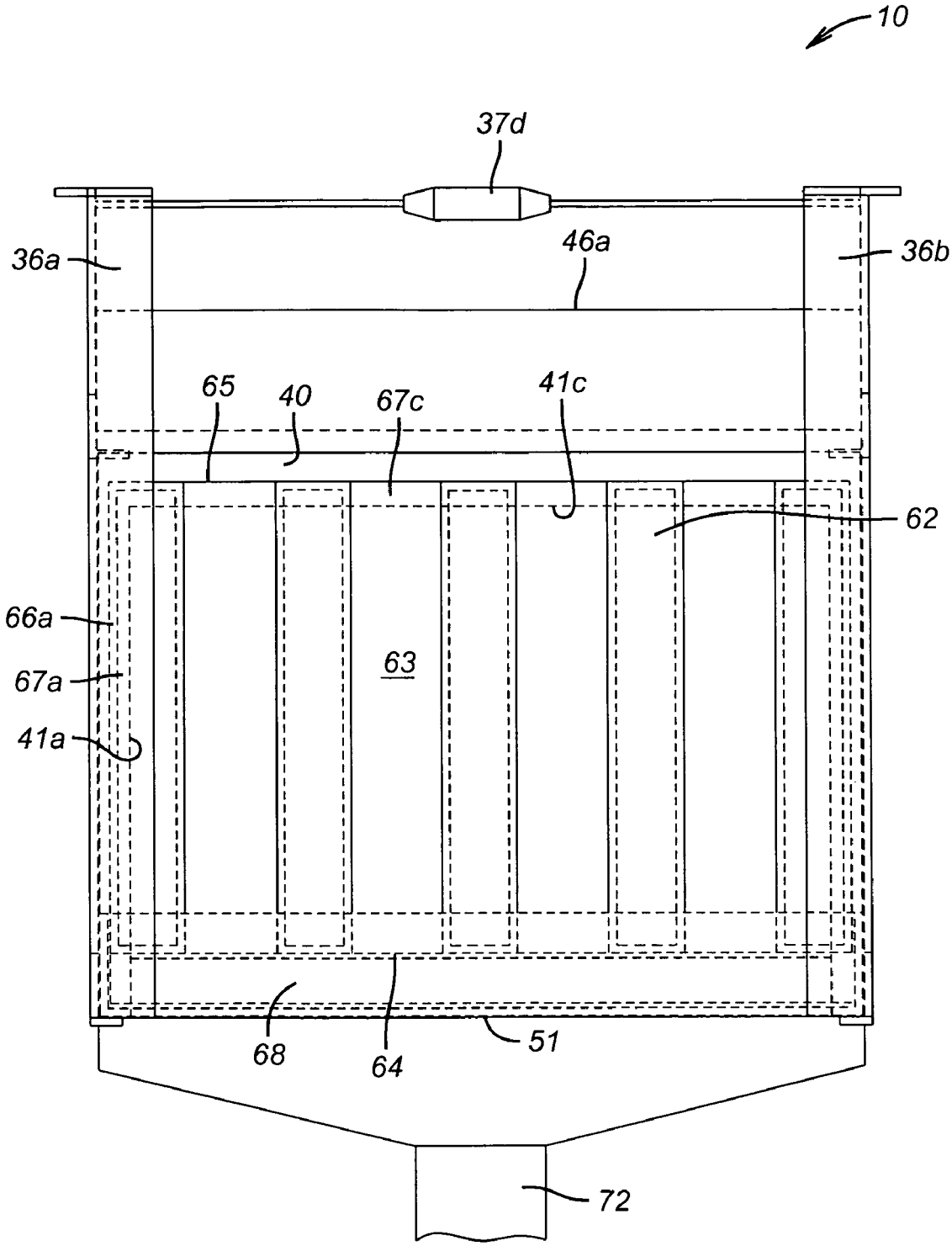

FIGS. 6, 6*a* and 6*b* comprise Fig. Set 6. FIG. 6 is a isometric view of the same ventilation duct flood guard apparatus as Fig. Set 2, with the buoyant door depicted in fully raised position as in Fig. Set 4 and depicts venting shutters in full lift. FIG. 6*a* is an orthogonal side view and FIG. 6*b* is an orthogonal end view from the end that is on the viewer's right in FIG. 6.

Figure 7:
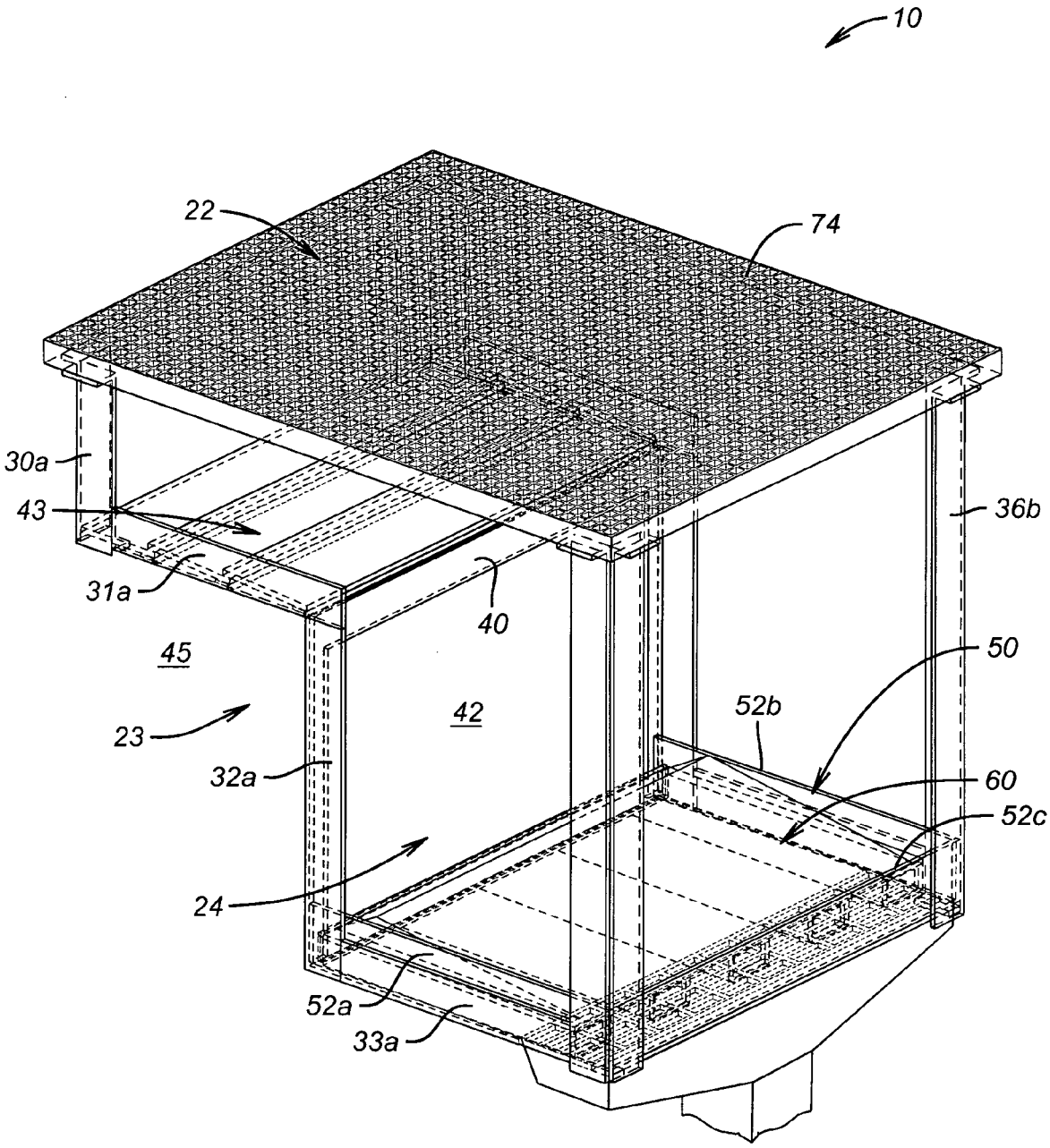
Figure 7A:
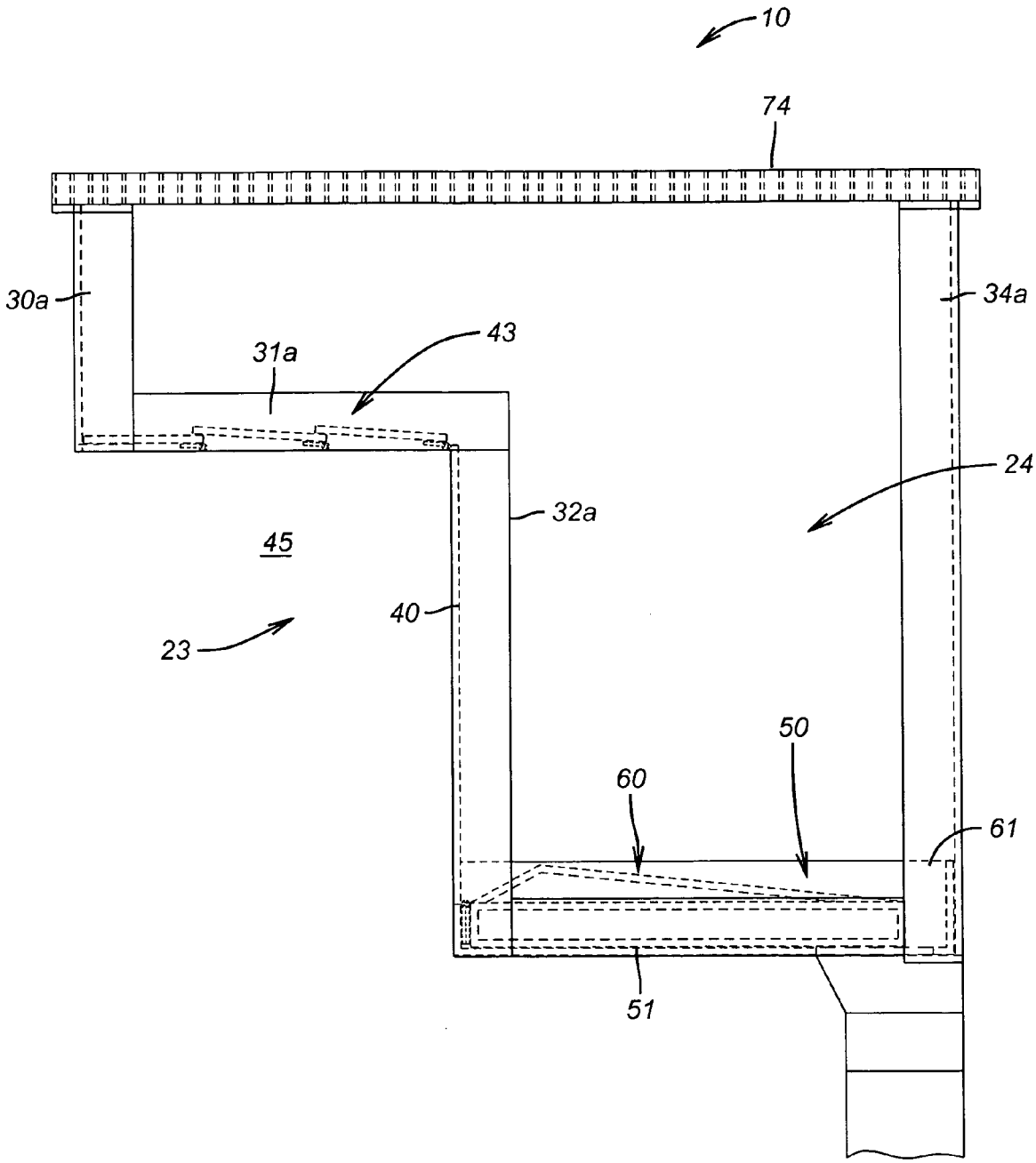
Figure 7B:
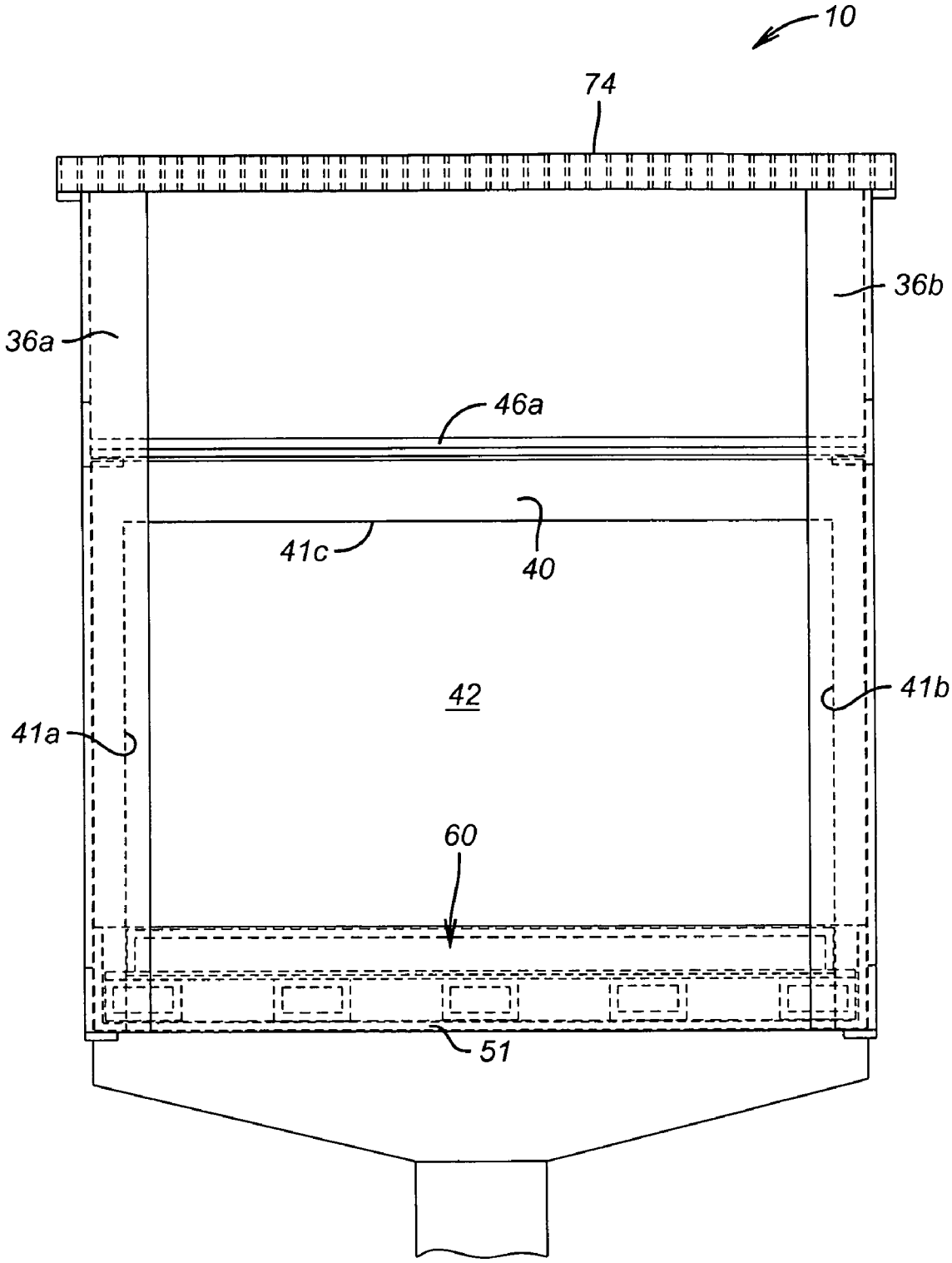

FIGS. 7, 7*a* and 7*b* comprise Fig. Set 7. FIG. 7 is an isometric view of another embodiment of a ventilation duct flood guard apparatus in accordance with this invention, with the buoyant door un-elevated, in horizontal position. FIG. 7*a* is an orthogonal side view and FIG. 7*b* is an orthogonal end view from the end that is on the viewer's right in FIG. 7.

Figure 8:
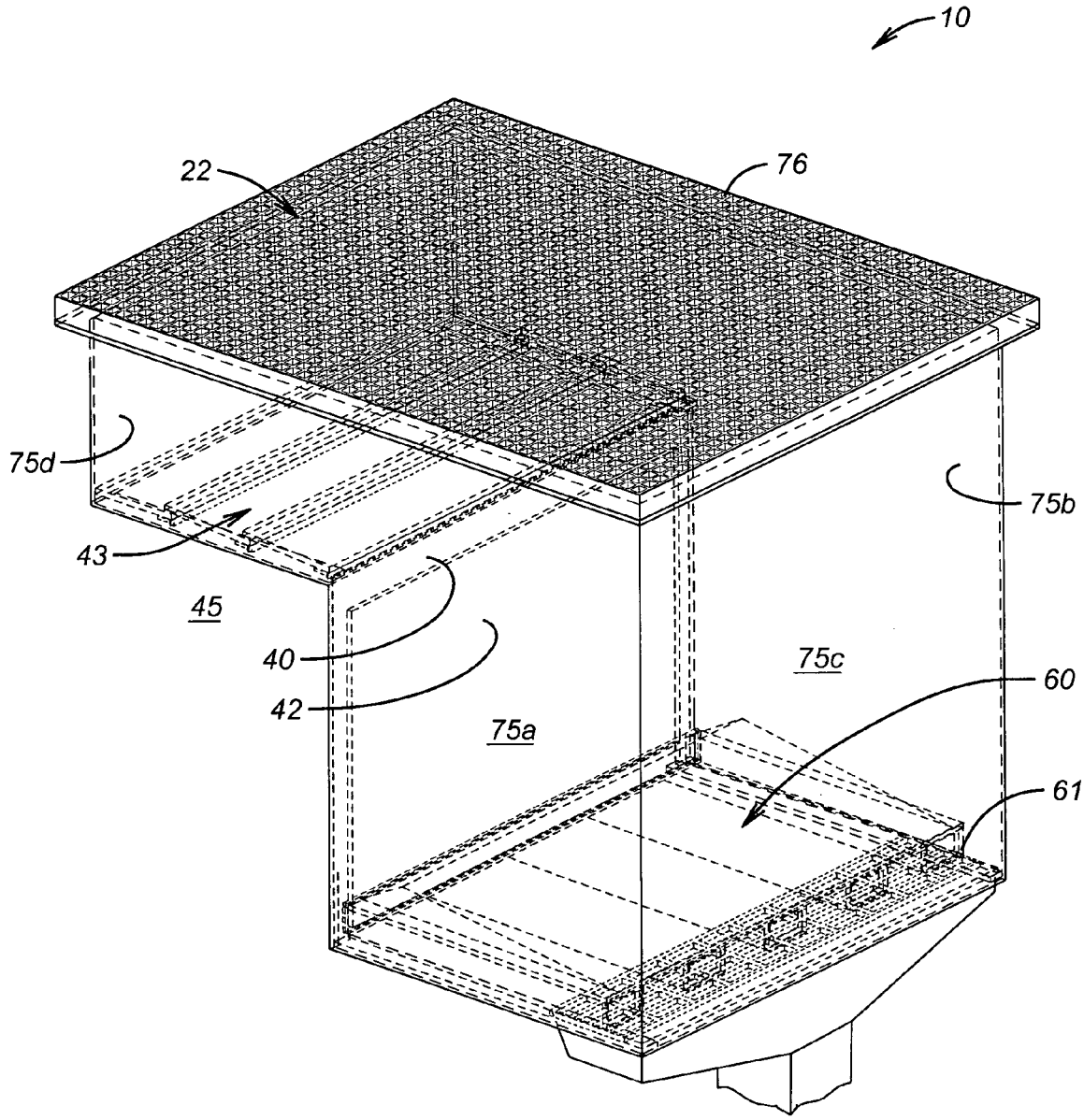
Figure 8A:
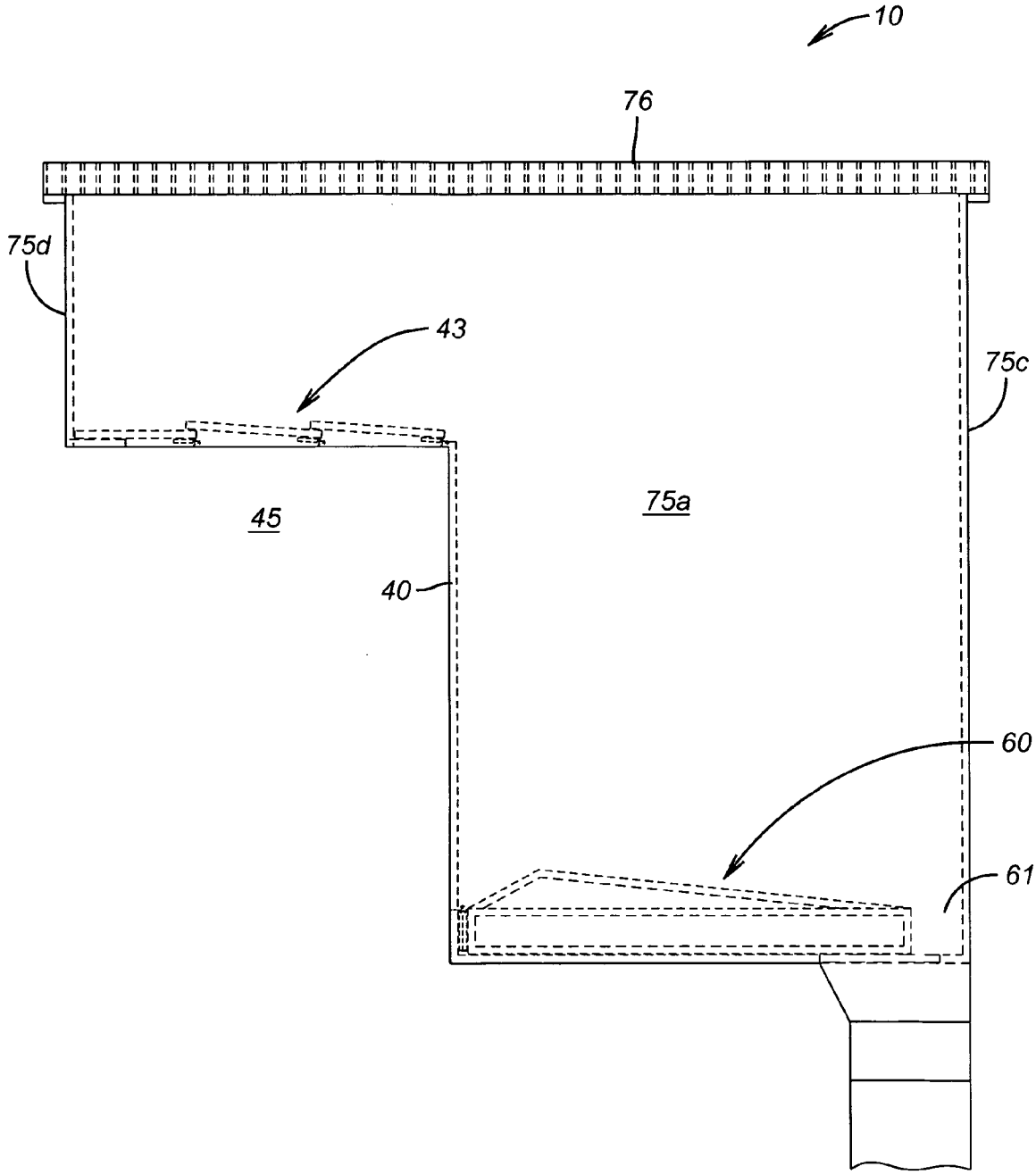
Figure 8B:
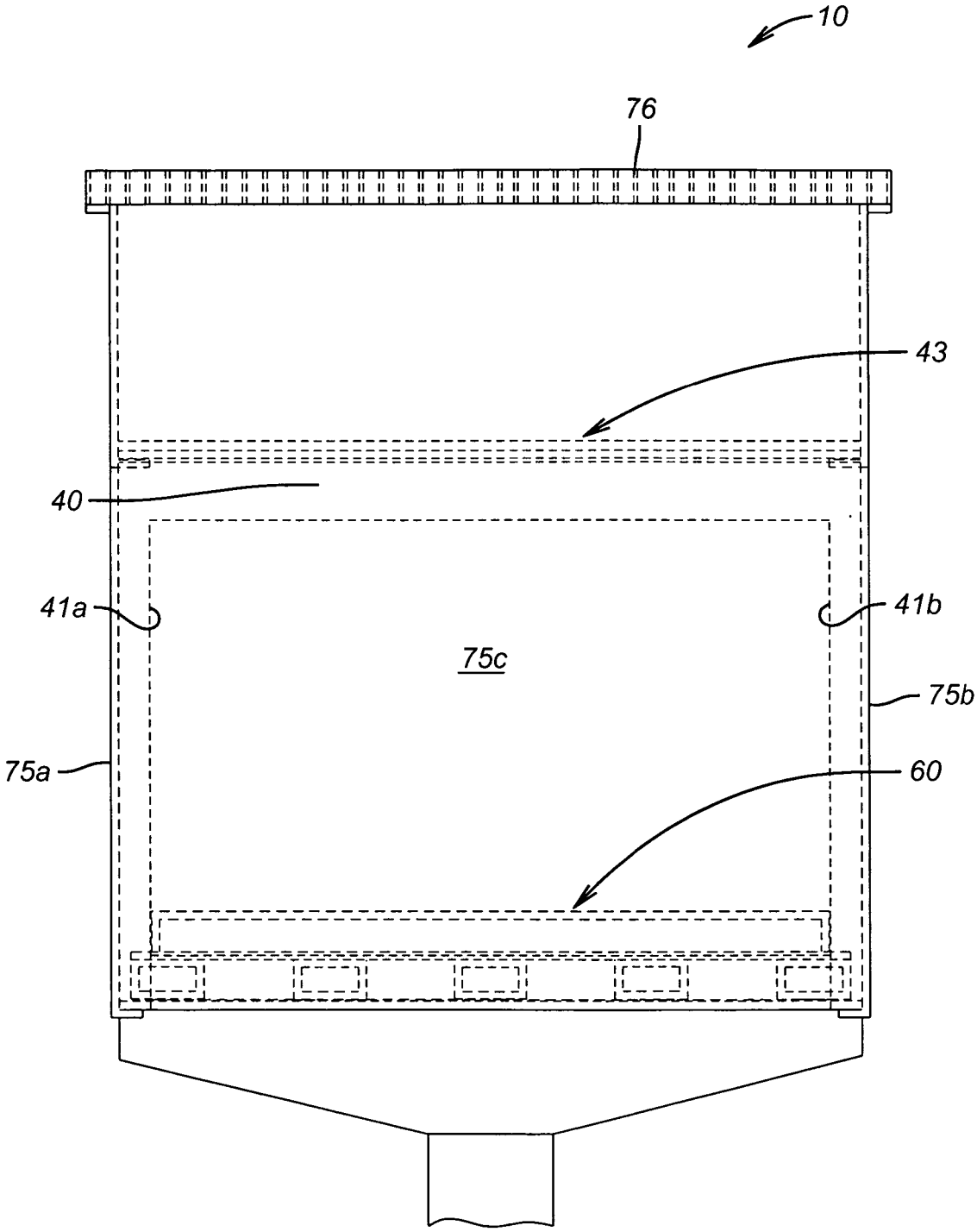

FIGS. 8, 8*a* and 8*b* comprise Fig. Set 8. FIG. 8 is still another embodiment of a ventilation duct flood guard apparatus in accordance with this invention, with the buoyant door un-elevated, in horizontal position. FIG. 8*a* is an orthogonal side view and FIG. 8*b* is an orthogonal end view from the end that is on the viewer's right in FIG. 8.

Figure 9:
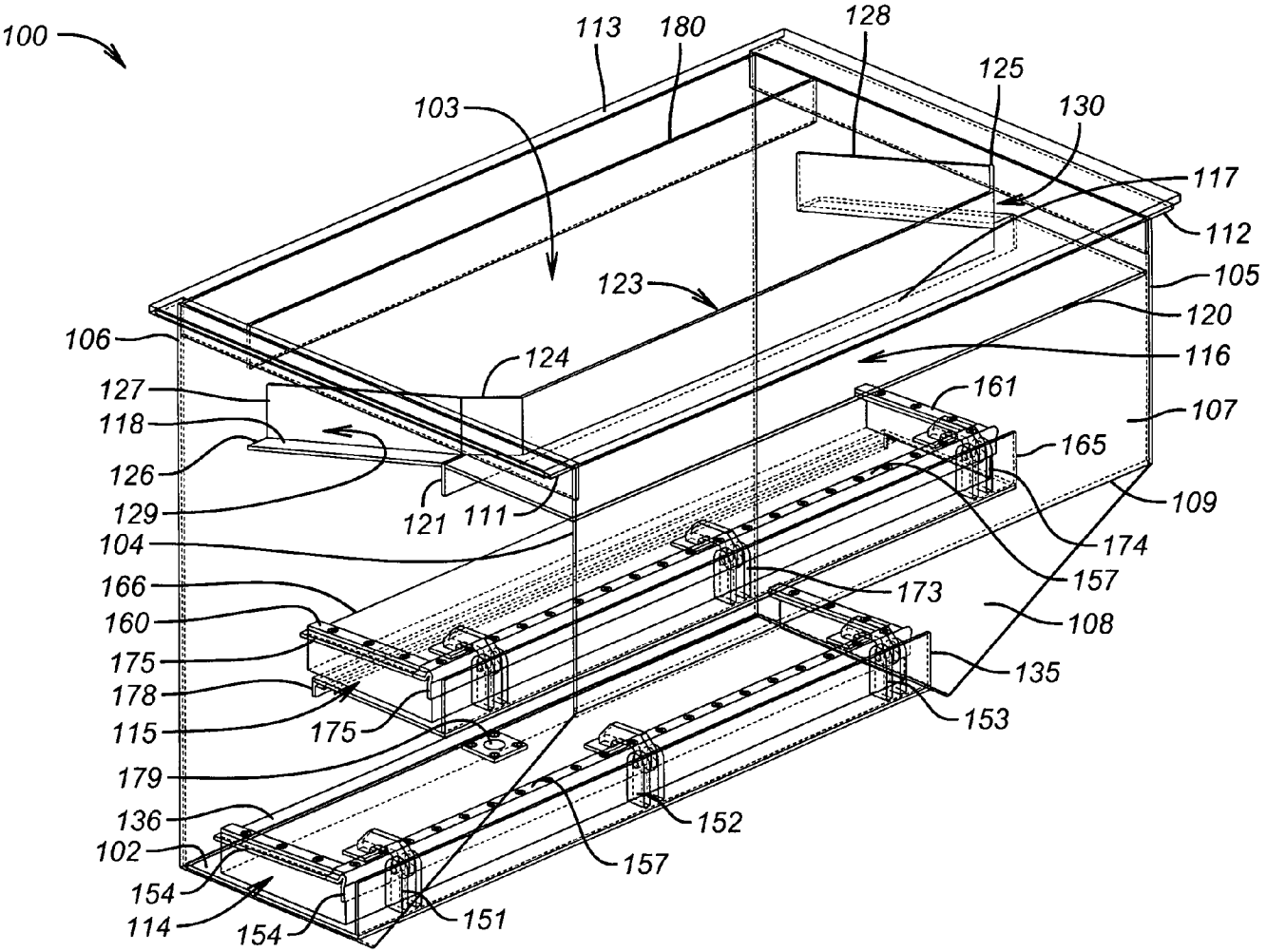

FIG. 9 is a isometric view of another embodiment of a ventilation duct flood guard apparatus in accordance with this invention, using a plurality of seat and buoyant gate sets. FIG. 9 is viewed from the same general vantage point as FIG. 2 but the embodiment depicted in FIG. 9 is rotated 180 degrees from the embodiments depicted in Fig. Sets 2-8. In the viewed direction of the orientation of the embodiment in FIG. 9, the buoyant gate elevates toward the viewer to close, whereas in the same viewed direction and different orientation of the embodiments of Fig. Sets 2-8, the buoyant gate as viewed elevates in a closing direction moving away from the viewer.

Figure 10:
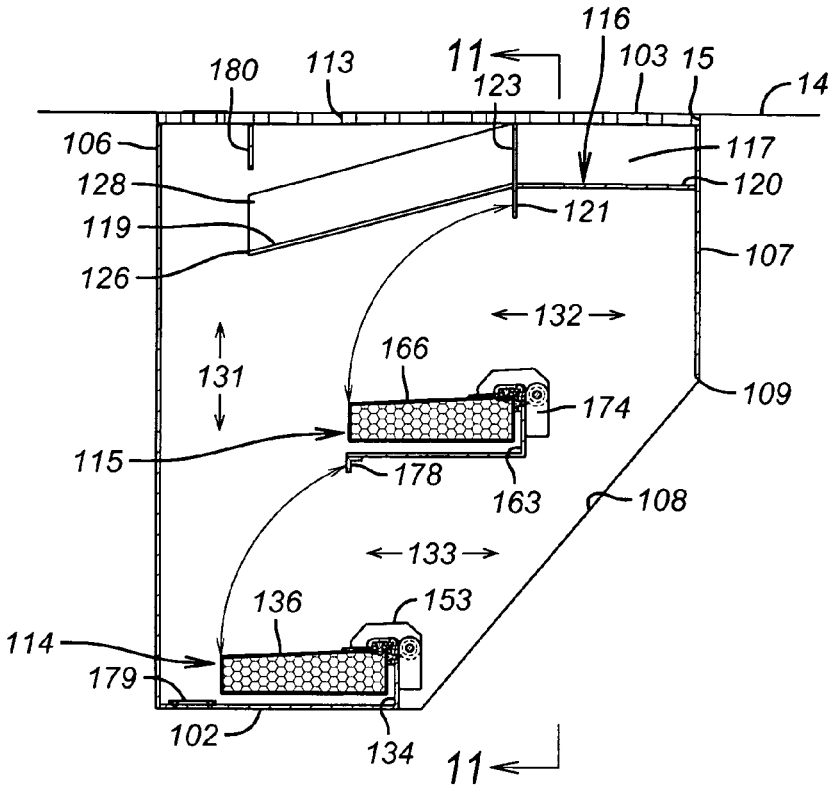
Figure 12:
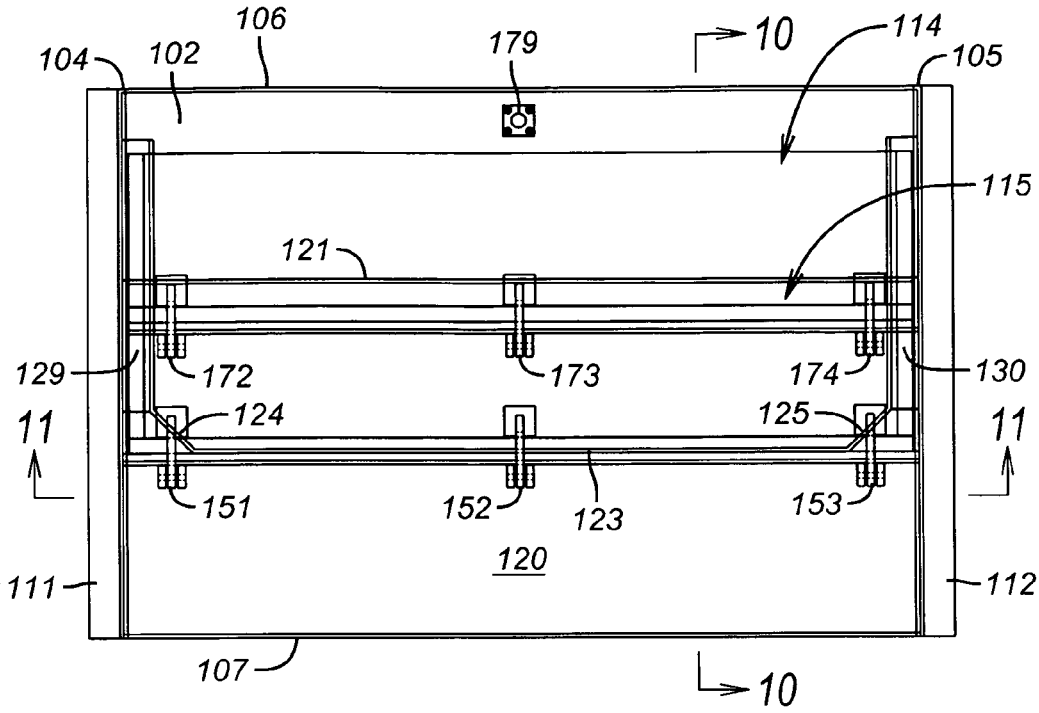

FIG. 10 is a cross sectional side view of the embodiment of FIG. 9 along the line 10-10 shown in FIG. 12.

Figure 11:
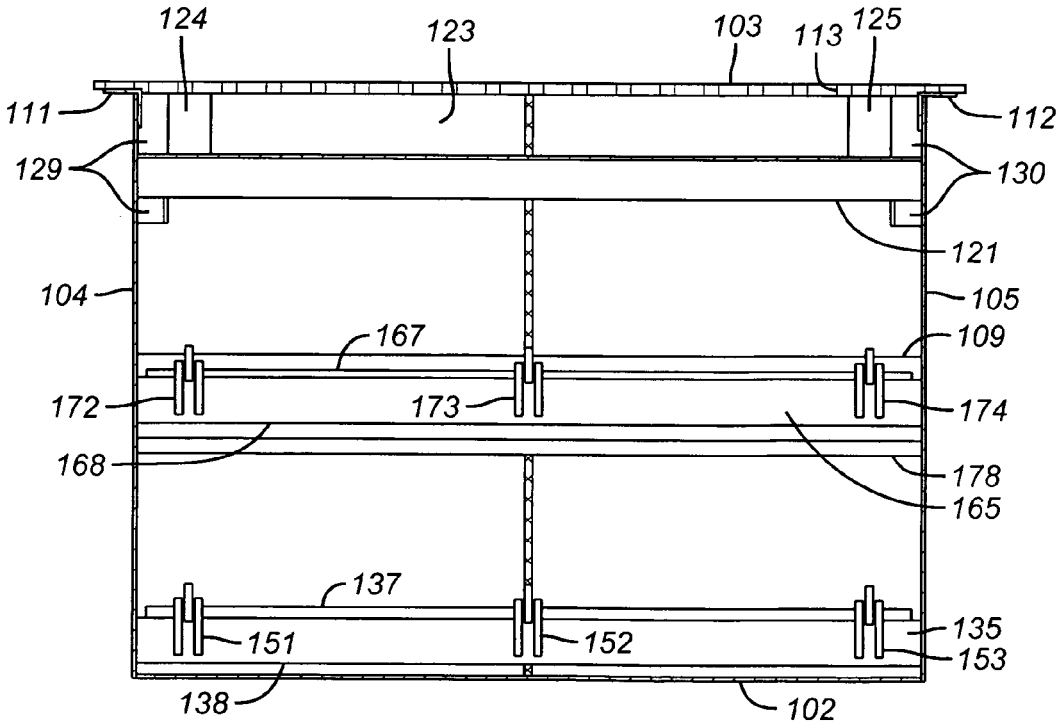

FIG. 11 is a longitudinal sectional view of the embodiment of FIG. 9 along the lines 11-11 shown in FIG. 12.

FIG. 12 is a top plan view of the embodiment of FIG. 9

Figure 13:
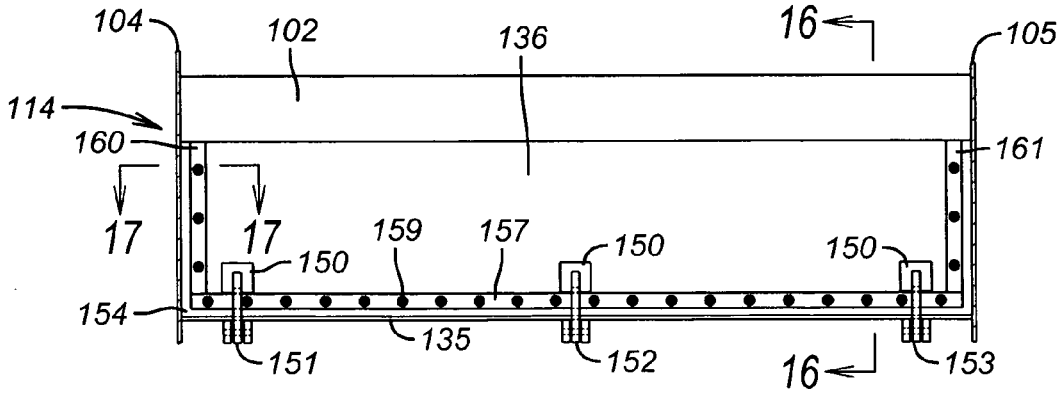

FIG. 13 is a top plan view showing the lower gate in the embodiment of FIG. 9.

Figure 14:
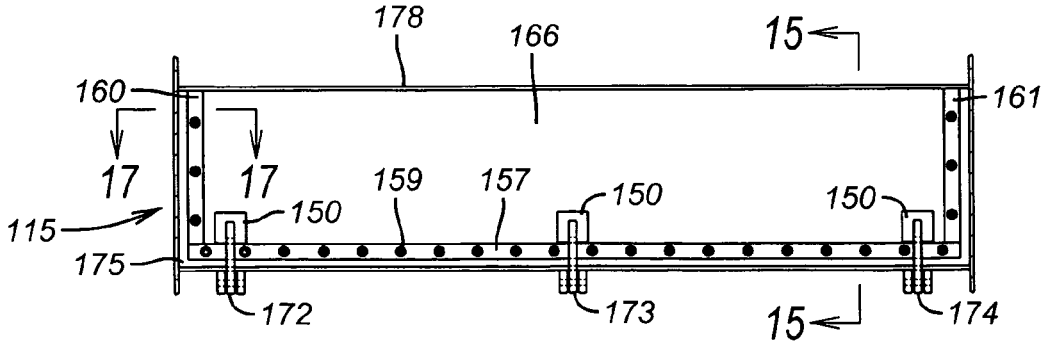

FIG. 14 is a top plan view showing the upper gate in the embodiment of FIG. 9.

Figure 15:
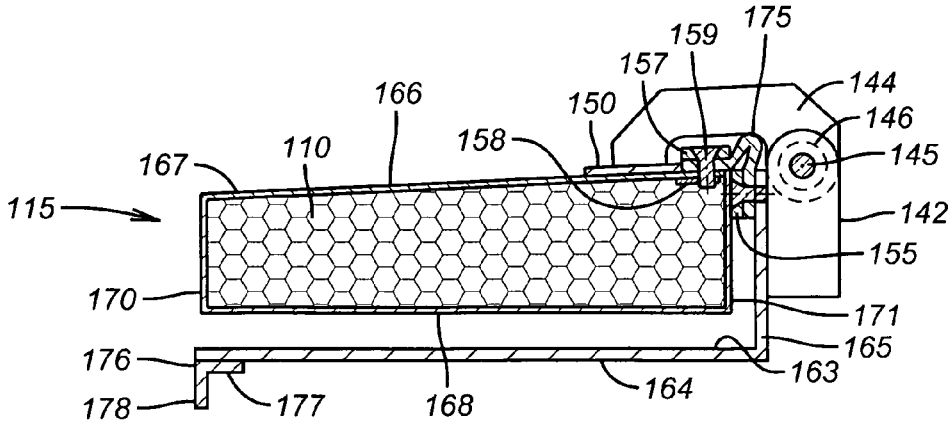

FIG. 15 is a cross sectional view of the upper gate of FIG. 14 along the lines 15-15 shown in FIG. 14.

Figure 16:
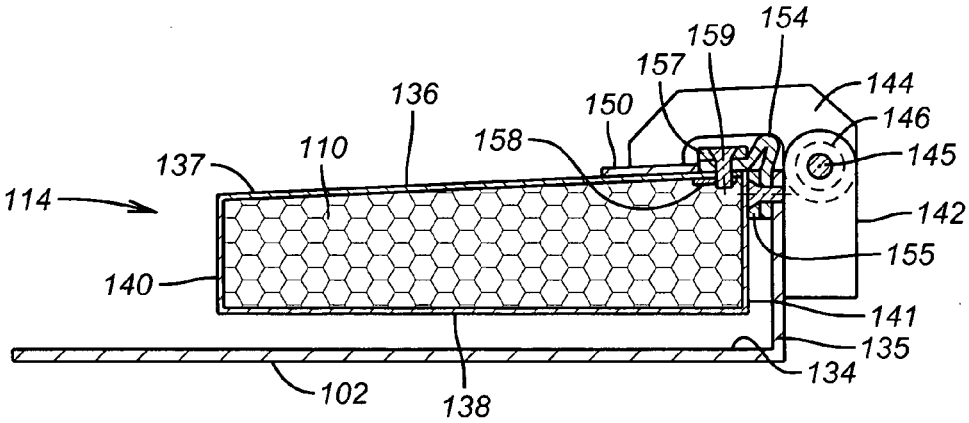

FIG. 16 is a cross sectional view of the lower gate of FIG. 13 along the lines 16-16 shown in FIG. 13.

Figure 17:
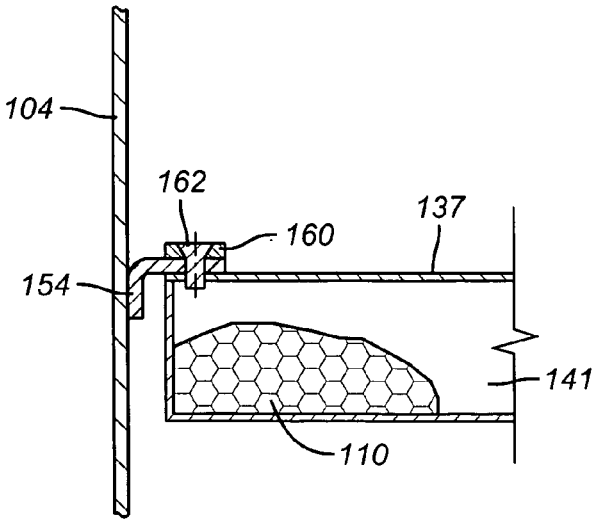

FIG. 17 is longitudinal section view along the length of the lines 17-17 in both FIGS. 13 and 14.

Figure 18:
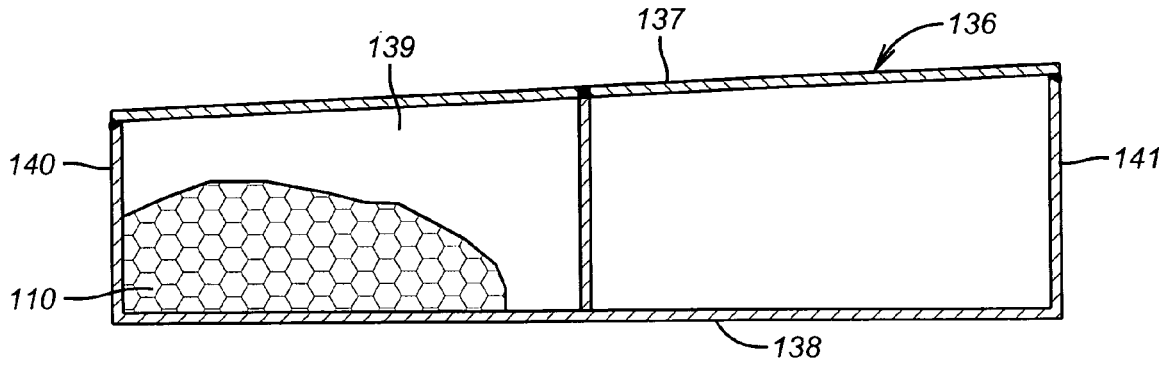

FIG. 18 is a side view of a gate of the embodiment of FIG. 9. with a portion of a side plate removed.

Figure 19:
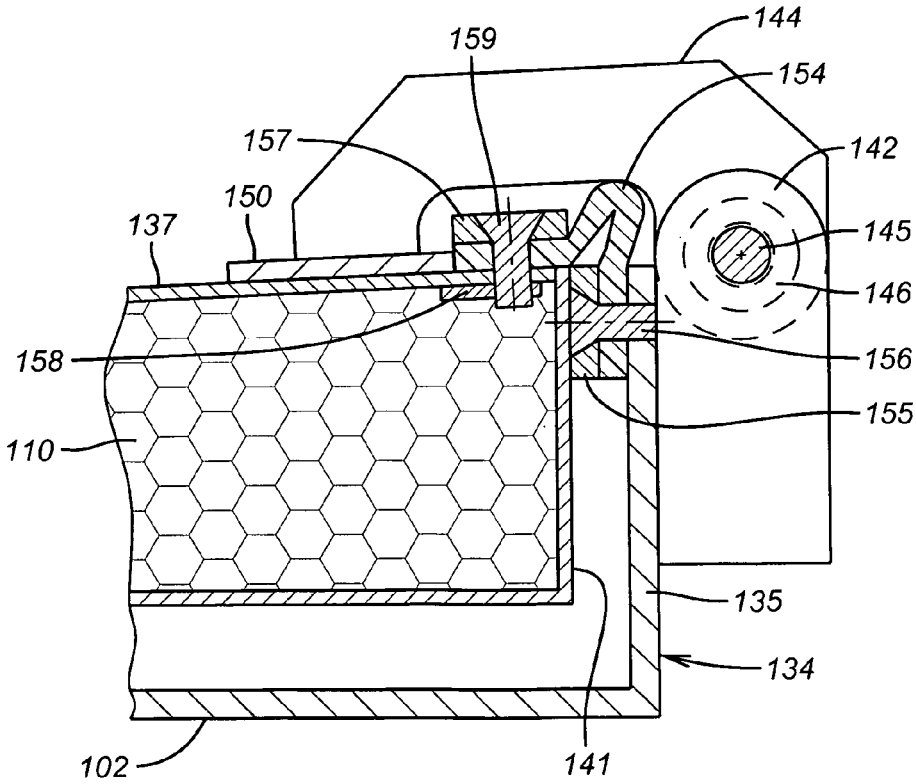

FIG. 19 is an enlarged cross sectional view of the portion of the gate assembly of FIGS. 15 and 16.

Figure 20:
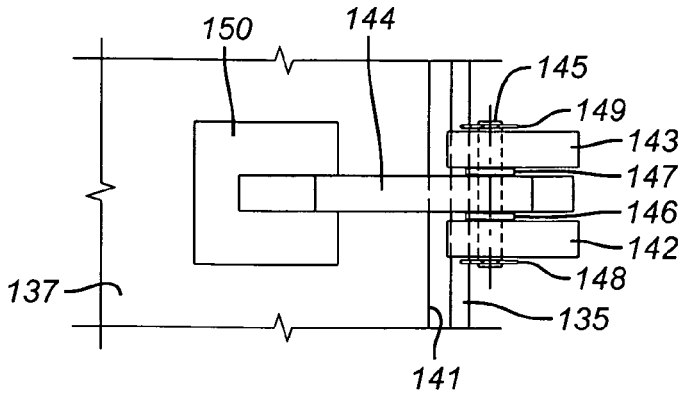

FIG. 20 is a top plan view of a detail of the pivotation assembly of the gates of FIG. 9.

Figure 21:
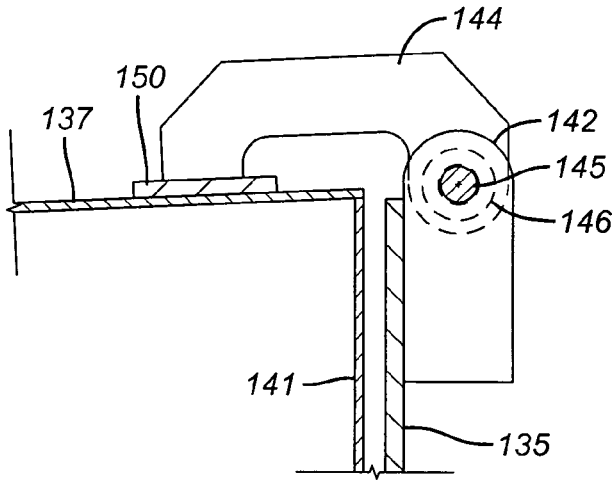

FIG. 21 is side sectional view along the line 21-21 of FIG. 20.

Figure 22:
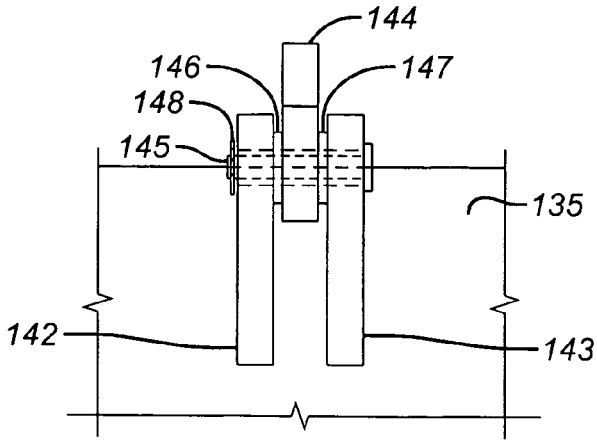

FIG. 22 is an end elevational view of a detail of the pivotation assembly of FIG. 20.

Figure 23:
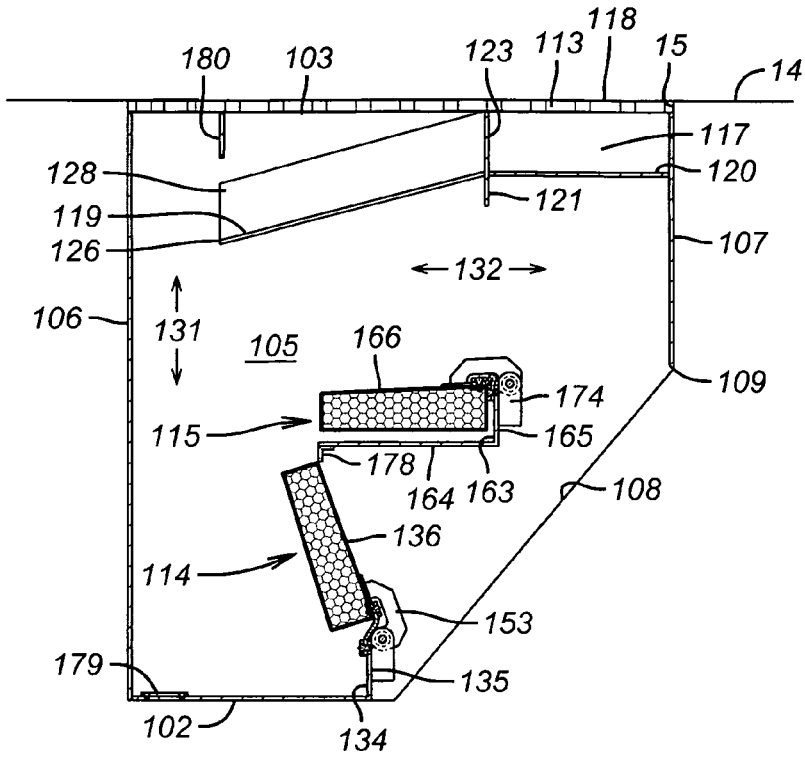

FIG. 23 is a view the same as FIG. 10 illustrating the bottom gate elevated to closed position and the upper gate un-elevated.

Figure 24:
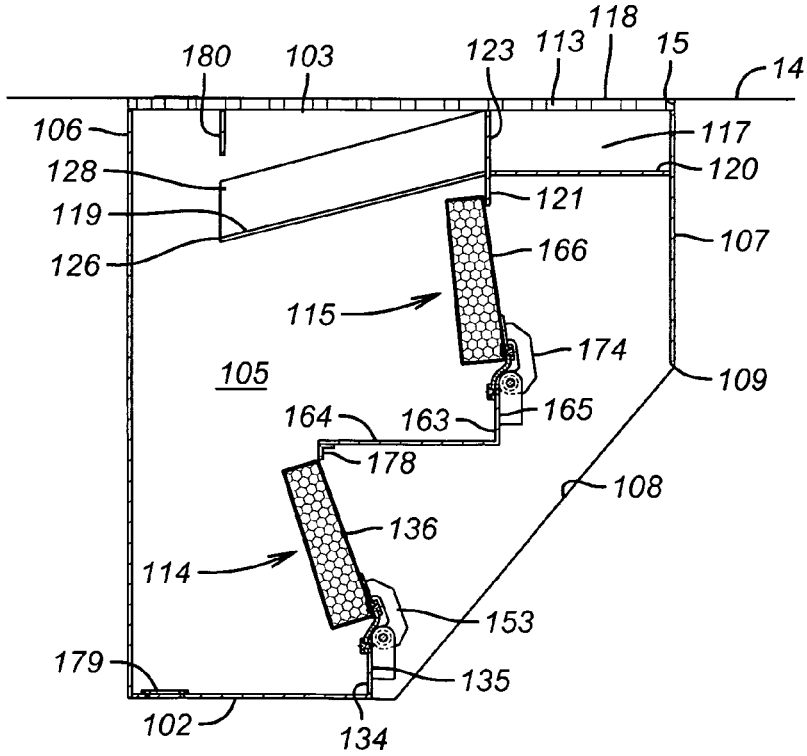

FIG. 24 is a view the same as FIG. 23 showing both gates elevated to closed position.

DETAILED DESCRIPTION OF EMBODIMENTS

The concepts embodied in the embodiments described herein have application to any system in which an opening at or near grade level communicates with a ventilation duct for an underground chamber or tunnel or other underground structure requiring ventilation, and through which opening substantial volumes of water can enter, as with heavy rain or street flooding. The embodiments of the invention automatically block downward flow of substantial surface water into an underground ventilation duct communicating upwardly to a ground surface opening. In the following detailed description of embodiments, reference is made to the accompanying drawings, which form a part hereof and in which are shown, by way of illustration, specific embodiments in which the invention may be practiced. Specific details disclosed herein are in every case a non-limiting embodiment representing concrete ways in which the concepts of the invention may be practiced. This serves to teach one skilled in the art to employ the present invention in virtually any appropriately detailed system, structure or manner consistent with those concepts. It will be seen that various changes and alternatives to the specific described embodiments and the details of those embodiments may be made within the scope of the invention. Because many varying and different embodiments may be made within the scope of the inventive concepts herein described and in the specific embodiments herein detailed, it is to be understood that the details herein are to be interpreted as illustrative and not as limiting.

The various directions such as "upper," "lower," "bottom," "top," "back," "front," "perpendicular", "vertical", "horizontal," "length" and width" and so forth used in the detailed description of embodiments are made only with respect to easier explanation in conjunction with the drawings. The components may be oriented differently while performing the same function and accomplishing the same result as the embodiments herein detailed embody the concepts of the invention, and such terminologies are not to be understood as limiting the concepts which the embodiments exemplify.

The term "nominal" is used in sense of not necessarily corresponding exactly to a real value. The term "perpendicular" means substantially at a right angle to a reference to a degree that if not absolutely a right angle will not materially adversely affect the arrangement and function of the element described as perpendicular. The terms "vertical" or "vertically" include but are not limited to literal vertical and generally mean oriented up and down with respect to the earth's horizon to a degree that if not absolutely vertical will not materially adversely affect the function of the element described as vertical. Similarly, the terms "horizontal" or "horizontally" include but are not limited to literal horizontal and generally mean not out of level with respect to the earth's horizon to a degree that will materially adversely affect the function of the element described as horizontal.

As used herein, the use of the word "a" or "an" when used in conjunction with the term "comprising" (or the synonymous "having" or "including") in the claims and/or the specification may mean "one," but it is also consistent with the meaning of "one or more," "at least one," and "one or more than one." In addition, as used herein, the phrase "connected to" means joined to or placed into communication with, either directly or through intermediate components.

As used in this application, the term "opposing sides" in respect to an opening is used without implication that the opening has a particular shape unless a particular shape is specifically stated. Thus the opening could be circular (opposing sides are any place in the periphery of the circle connected by the longest line segment, which is the diameter), square (longest line segment is the same for all opposing sides), rectilinear (longest line segment end points are in the opposing shorter sides of the rectangle, that is, the longest line segment lies in a plane along the length of the rectangle) or other geometric shape. The term "fixed distance" or "fixed length" refers to a line segment whose end points are in opposing sides of a surface opening of a ventilation system. The term "longest distance" refers to a longest line segment whose end points are in opposing sides of a surface opening of a ventilation system. In the instance of a rectangle, the term "fixed distance" can be a distance between either the shorter or the longer opposing sides of the rectangle.

The term "duct" is used herein to apply generically to any air shaft, tube, conduit, vent, bore, channel, vessel, or any other conveying path by which ventilation is supplied underground to or from a ground level opening or any opening to atmosphere. In the context of subways, these vents are commonly referred to as ventilation shafts. The term "duct" includes but is not limited to a subway ventilation shaft, and includes any terminal portion of the duct beneath the surface opening, which may take the form of a chamber or cavity below the surface opening.

The various embodiments detailed herein employ at least one seat and buoyant gate set interposed in a ventilation system duct for an underground structure below a ground surface level opening of the vent to automatically block flow of water entering the ventilation duct through the surface opening. The embodiments described in connection with Fig. Sets 2-8 use a single seat and buoyant gate set for this purpose. The embodiment described in connection with FIG. 9 demonstrates use of a plurality of seat and buoyant gate sets. All embodiments comprise a support for a seat and buoyant gate set. In some embodiments, a framework provides the support. Those embodiments are described in Fig. Sets 2-7. In other embodiments, the support is provided by an enclosure. Those embodiments are described in FIGS. 8-24. The embodiments described herein illustrate that the concepts of the invention may be variously packaged, and these will be instructive for other packaging of the elements for ventilation duct openings that differ in size, location and dimension. Arrangements of elements are described for less restriction of airflow when the ventilation duct is in normal use.

Figure 1:
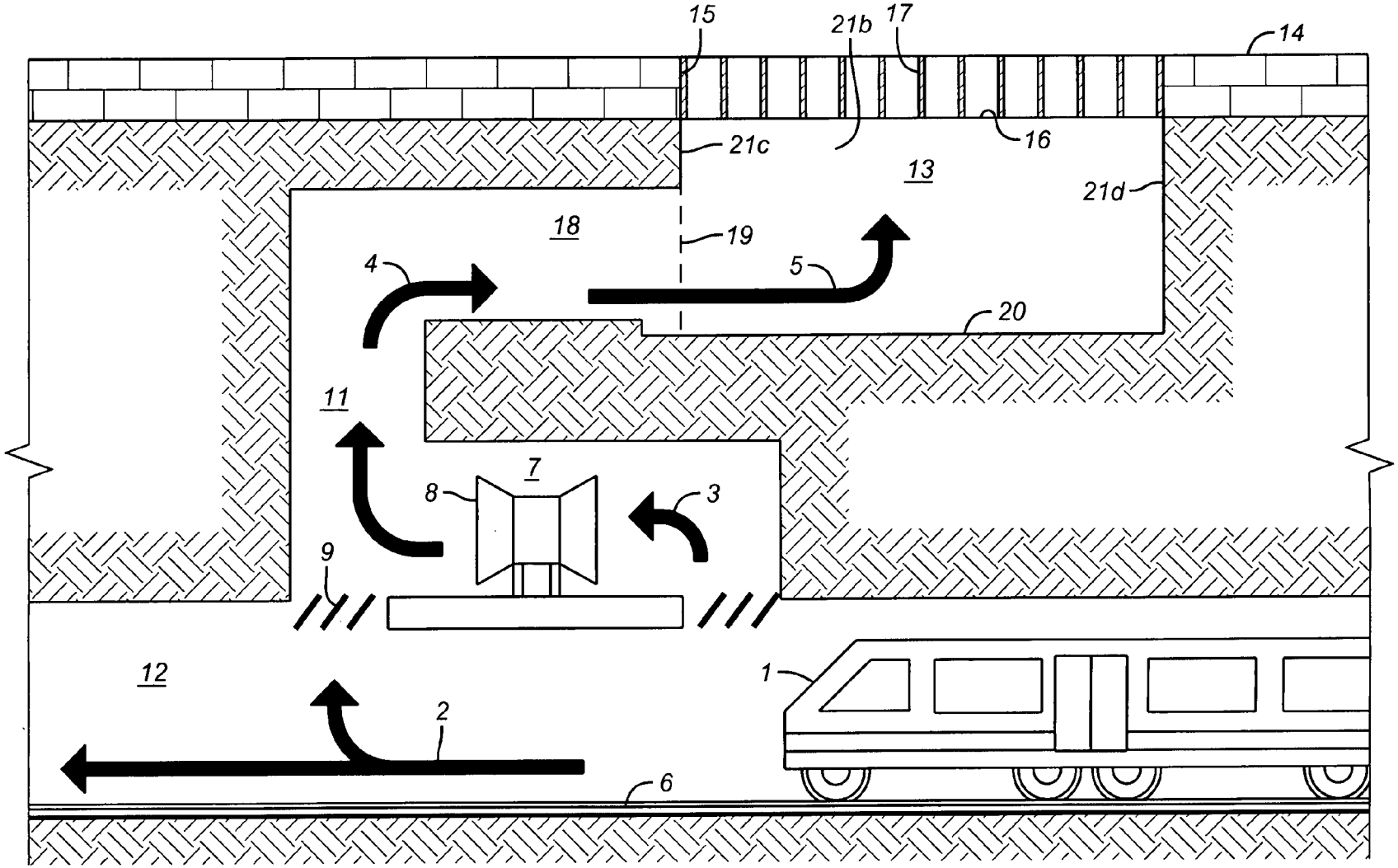
FIG. 1 diagrammatically depicts a typical subway ventilation system protected by embodiments of the invention.

For illustrative purposes of an application of the concepts and the methods herein disclosed for automatically blocking entrance of substantial amounts of water into a ventilation duct, the embodied concepts are described in reference to a specific ventilation environment. The exemplary application is for a subway system, which depends on ventilation and where an urgent need exists for a solution to stop flooding. It is helpful, accordingly, to see a typical subway ventilation arrangement. Reference is made to FIG. 1, where a typical subway ventilation system is diagrammatically depicted.

Subway trains moving through underground tunnel tubes have a piston effect, pushing air in front of them and pulling air in behind them. Ventilation ducts or shafts are incorporated into subway systems near stations to exhaust stale pushed air as the train nears a station and to pull in fresh outside air as a train leaves a station, indeed, the ventilation or air shafts are sometimes called blast or surge shafts because of the blast of air they expel. They also provide a route to remove smoke in the event of a fire in a station or on the tracks or in a train. Referring to FIG. 1, airflow pushing ahead of a train 1 is indicated by heavy arrow lines, as at reference numerals 2-5. A track 6, fan room 7, fan 8 and dampers 9 are depicted for context. A ventilation duct or shaft 11, 18 communicates from underground tunnel 12 and terminates in a subterranean discharge structure 13 below grade level 14 that opens to the atmosphere (opening 15) at grade level 14 where the opening is covered by a subway grating 17.

Subways have systems for handling water. When it rains, water runs down stairwells, onto platforms and thence onto tracks, and some gets in the ventilations systems through the surface grates. Drains beneath the tracks pipe water to underground sumps in pump rooms next to the subway tracks. Pumps pull the water up to pressure relief manholes open to the atmosphere at street level; from there the water drains under gravity flow into city storm sewers. The problem is that in heavy rains, storm sewers are overwhelmed and flush water back into the streets, flooding the streets with ponds of water that inundate sidewalk curbs and pour through subway grates into the ventilation system thence into the tunnels and onto the tracks. The pumping system can only return water to the flooded street; from there the water reenters the flood pool pouring into the ventilations system, defeating the pumping system as a means of controlling subway flooding.

The problem presented by flooding subways is acute for city transportation. Water in the subway creates danger and paralyzes the system. The subway system has two vital sources of power: the direct current that moves the trains, and the alternating current that powers the signals. When water rises near the electrically charged third rail, it creates dangerous conditions. The high voltage running through the third rail (600 volts and greater) electrifies the water, causing it to boil and setting floating debris on fire, creating smoke. High capacity fans are sometimes provided in fan rooms above the tracks that open to a vertical run of the ventilation ducts. The fans aid in the removal of smoke. But water from flooded streets pouring through subway grates into the ventilation ducts interferes with smoke removal, leading to a smoke condition in the tunnels and in the stations. Even if the direct current is unaffected, water short-circuits the electrical signals and switches, making it impossible for train operators to know when it is safe to stop or go, so trains cannot be safely operated.

In the specific embodiments described herein as examples, it is assumed the grade level opening through which flooding waters enter has a rectilinear shape, as for grated grade level sidewalk openings for subway ventilation systems, which at least in New York City in the United States typically are rectangular and oriented with the long dimension running in the direction of the adjacent street. Although the descriptions of specific embodiments relate to a rectilinear shape and for a particular environment, the invention does not require that the opening be rectilinear or that embodiments of the invention conform to a rectilinear shape. The elements of the invention can be configured to fit within the downwardly vertically projected dimensions of any ventilation duct surface opening serving any underground tunnel, chamber, room or other underground structure.

The embodiments described herein comprise a support having a top opening and an opening in a lower portion above a support floor or bottom. The opening in the lower portion is for venting communication with a proximate portion of a ventilation duct, for example, a venting discharge structure or a terminal run of the ventilation duct in a subway venting system. The support supports at least one seat and a paired buoyant gate normally disposed perpendicular to the seat, the seat and gate together forming a set.

In an embodiment, the seat is mounted above at least a portion of a passageway under the seat for fluidly communicating to the top opening of the support and to the proximate portion of the ventilation duct to provide ventilation through the embodiments in normal non-flooding conditions. The buoyant gate is buoyantly moveable with respect to the seat, is positioned lower than the seat and the passageway under the seat, is normally disposed perpendicular to the seat, is of sufficient size to block the passageway, and is responsive to water rising in the support by floatingly upwardly until engaging the seat, thereby blocking the passageway.

In an embodiment, each seat and gate set may be arranged in the support to provide airflow from the lower portion opening to a surface opening that is less restrictive under normal conditions yet still provides automatic flooding protection. This arrangement applies a nominal fraction in which the numerator is 1 and the denominator is the sum of 1 plus the number of seat and gate sets, to a chosen distance separating opposed sides of the surface opening of the ventilation duct, to locate the place to fix the seat of a single seat and gate set or the seats of a plurality of seat and gate sets.

In an embodiment, a sloped surface declines in a direction away from the seat to flow water introduced through the top opening away from the lower opening.

In an embodiment, the support supports a shelf at least a portion of which is under at least a portion of the top opening and above the lower opening for shielding the lower opening from water introduced through at least the top opening portion over the shelf.

Various embodiments that employ one or more of these concepts and concepts that are additionally described in the several embodiments are now described in detail.

The Embodiments of Fig. Sets 2-8

The illustrative embodiments of Fig. Sets 2-8 are single seat and gate set embodiments, packaged and arranged for below grade fitment in a rectangular street level subway opening 15, as an example. In an embodiment described, the gates may close and open about a pivotation axis that is perpendicular to the longest distance of the surface opening 15, i.e., for a subway system such as the New York City, where the street level grated openings typically are rectangular and oriented with the long dimension running in the direction of the adjacent street, the pivotation axis is perpendicular to the direction of the adjacent street and curb.

Referring to Fig. Sets 2-7, apparatus 10 comprises a support assembly 25 adapted to be mounted in an underground enlargement of a ventilation duct to a tunnel or other underground cavity, the enlargement having a floor and opening to atmosphere, for example, in the embodiments of FIGS. 2-8, in a structure such as enlargement structure 13 communicating with a ventilation duct 11, 18 to a tunnel 12 and having a floor 20 and an opening 15 to atmosphere.

Support assembly 25 has upper and lower extremities, respectively at 26, 27. In the embodiment of Fig. Sets 2-7, support assembly 25 comprises a framework 28 the upper extremity 26 of which includes flanges 29*a*-29*h* adapted to interposingly sit on lip 16 below a sidewalk vent grate 17 and thereby hang support assembly 25 in structure 13 under vent grate 17. More particularly, referring to Fig. Sets 2-7, framework 28 has first upper vertical members 30*a*, 30*b* terminating at upper extremities in flanges 29*g*, 29*b* respectively. Fastened perpendicularly along the length of vertical members 30*a*, 30*b* are second upper vertical members 35*a*, 35*b* terminating at their upper extremities in flanges 29*h*, 29*a* respectively. To first upper vertical members 30*a*, 30*b* are fastened first horizontal members 31*a*, 31*b*, from which depend first lower vertical members 32*a*, 32*b* fastened thereto at right angles. Second horizontal members 33*a*, 33*b* fasten at right angles to first lower vertical members 32*a*, 32*b* and connect to third vertical members 34*a* and 34*b*, which terminate in their upper extremities at flanges 29*f* and 29*c* respectively. Fastened perpendicularly along the length of third vertical members 30*a*, 30*b* are fourth vertical members 36*a*, 36*b* terminating at their extremities in flanges 29*e*, 29*d* respectively.

Turnbuckle 37*a* adjusts first upper vertical member 30*a* and fastened second upper vertical members 35*a* relative to third vertical member 34*a* and fourth vertical member 36*a*, and correspondingly, turnbuckle 37*b* adjusts first upper vertical member 30*b* and fastened second upper vertical member 35*b* relative to third vertical member 34*b* and fourth vertical member 36*b* as needed to adjust to the length of grade level opening 15 opening; and turnbuckle 37*c* adjusts first upper vertical member 30*a* and fastened second upper vertical members 35*a* relative to first vertical member 30*b* and second upper vertical member 35*b*, and correspondingly, turnbuckle 37*d* adjusts third vertical member 34*a* and fastened fourth vertical member 36*a* relative to third vertical member 34*b* and fourth vertical member 36*b* as needed to adjust to the width of grade level opening 15 opening. As adjusted, flanges 29*a*-29*h* better fit to sit on lip 16.

Framework members 30*a*, 31*a*, 32*a*, 33*a* and 34*a* on the near side as viewed in FIGS. 2-7, and 30*b*, 31*b*, 32*b*, 33*b* and 34*b* on the far side as viewed in FIGS. 2-7, are adapted to fit snugly against sidewalls 21*a*, 21*b*, respectively, of structure 13, so that water entering structure 13 from opening 15 does not materially pass between sidewall 21*a* and the outer surfaces of framework members 30*a*, 31*a*, 32*a*, 33*a* and 34*a* and between sidewall 21*b* and the outer surfaces of framework members 30*b*, 31*b*, 32*b*, 33*b* and 34*b*. Gaskets or other suitable sealing materials optionally may be provided to seal any gaps between the sidewalls and the outer surfaces of said framework members. The area of the support laterally interiorly of flanges 29*a*-29*h* and turnbuckle assemblies 37*a*-37*d* comprises a top opening 22 of framework 28.

First lower vertical members 32*a*, 32*b* of framework 28 comprise a seat support securing a seat 40 within structure 13 below grade level opening 15. In the example for which the embodiment depicted in Fig. Sets 2-8 is described, apparatus 10 is oriented so that the seat 40 is perpendicular the plane containing the longest distance between opposing sides. Seat 40 is supported vertically by first lower vertical members 32*a*, 32*b* and secured to transect a lower portion of structure 13 under opening 15 perpendicular to the plane containing the longest distance in opposing sides of opening 15 (that is, perpendicular to the length of rectilinear structure 13). Alternatively, apparatus 10 may be oriented so that seat 40 is parallel to the plane containing the longest distance between opposing sides. Seat 40 then would be secured to transect a lower portion of structure 13 under opening 15 parallel to the plane containing the longest distance in opposing sides of opening 15 (that is, parallel to the length of rectilinear structure 13). This later orientation is illustrated as an example for the embodiment of FIG. 9.

In the embodiments of Fig. Sets 2-8, for less restrictive airflow through apparatus 10 during normal use, seat 40 may be mounted under top opening 22, spaced from one of the opposing shorter sides of rectangular opening 15, a horizontal distance nominally equal to a fraction applied to the length of the distance separating those two shorter sides. That fraction has a numerator of 1 and a denominator that is the sum of 1 plus the number of seat and gate sets. In the embodiments of Fig. Sets 2-8, there is one seat and gate set, so the fraction is 1 over 1+1=2, or ½. Accordingly, in an arrangement of the embodiment disposed in a rectangular opening 15 in which single seat 40 is perpendicular to the length of the rectangular opening, this location is about half the longest distance between the opposing short sides of rectangular grade level opening 15, that is, about half the length of the rectangular opening 15 of structure 13. For example, if the opening 15 is rectangular and is five feet long by four feet wide, and if apparatus 10 is to be disposed in the rectangular opening with seat 40 perpendicular to the length, apparatus 10 would be constructed such that seat 40 would be placed about half of five feet (2.5 feet) from one of the shorter four feet long sides of the rectangular opening. Packaging limitations for specific sites often involve some compromise, so the term "nominal" or "about half" signifies that the seat is placed as reasonably near the location indicated by application of the fraction to the selected distance in the opening 15 as practical packaging and other constraints allow.

Seat 40 separates within apparatus 10 an "aft" lower portion 23 (which when secured in structure 13 will be proximate ventilation duct 18) and a "fore" portion 24 (which when secured in structure 13, will be distal to ventilation duct 18). Aft lower portion 23 faces and opens to the proximate portion of duct 11 ending at 18 when apparatus 10 is installed. Seat 40 has inner margins 41*a*, 41*b*, 41*c*, 41*d* defining within them a vertically oriented entrance 42 for horizontal airflow from the opening of aft lower portion 23 proximal to ventilation duct portion 18 to the fore portion 24 of apparatus 10 when apparatus 10 is secured in structure 13 and not operative preventing substantial amounts of surface storm waters from entering ventilation duct 11, 18.

Framework 28 supports a shelf 43 under at least a portion of top opening 22 and above the lower opening 42 for shielding lower opening 42 from water introduced through at least the top opening portion over shelf 43. Shelf 43 is supported and fastened to in-turned flanges 44*a*, 44*b* and fastens laterally to first horizontal members 31*a*, 31*b* of support assembly 25. Shelf 43 extends horizontally into apparatus 10 a distance terminating adjacent the top of seat 40. In an embodiment, shelf 43 extends not more than about half the longest distance in opposing sides of grade level opening 15. Shelf 43 defines below it a horizontally oriented flow passageway 45 located in aft lower portion 23. Passageway 45 leads from horizontal ventilation duct 18 to entrance 42 for airflow from ventilation duct 11, 18 into fore portion 24 beyond shelf 43. Inner margins 41*a*, 41*b*, 41*c*, 41*d* of seat 40 surround passageway 45 where it exits at entrance 42.

In the embodiments depicted in Fig. Sets 2-8, shelf 43 comprises one or more normally closed pivotally mounted shutters 46, as shown, 46*a*, 46*b* and 46*c*, occupying a position over horizontally oriented flow passageway 45. The shutters 46 are openable by pressure in horizontally oriented flow passageway 45 in excess of pressure in structure 13 above shutters 46 when apparatus 10 is secured in structure 13 and, as described below, entrance 42 is blocked. Pressure in horizontally oriented flow passageway 45 is the pressure in ventilation duct 11, 18 when apparatus 10 is secured in a structure 13, which is when, in operation to guard ventilation duct 11, 18 from storm water, apparatus 10 functions to block entrance 42. Shutters 46*a*, 46*b* and 46*c* relieve blast pressure in ventilation duct 11, 18 when entrance 42 is blocked. Pressure from ventilation duct 11, 18 sufficient to overcome the hydrostatic pressure of water than has risen above shelf 43 will blast open shutters 46*a*, 46*b*, 46*c*, expelling that overhead water upwardly through sidewalk grating 17 covering opening 15. This acts as a safety valve preventing blast pressure from dislodging the engagement of buoyant gate on seat 40. When the ventilation duct blast pressure subsides, shutters 46*a*, 46*b*, 46*c* will collapse to their normal horizontal shelf position pressed into sealing engagement by any water accumulating over them. Some leakage will occur but substantial amounts of surface water will be prevented by blocked entrance 42 from entering the ventilation duct.

A horizontal receptacle or pan 50 having a flat bottom 51, side members 52*a*, 52*b* and end members 52*c*, 52*d* is secured in the lower extremities of support assembly 25. End member 52*d* is fastened to a lower portion of seat 40 below seat margin 41*d*. Side members 52*a*, 52*b* are fastened to second horizontal members 33*a*, 33*b*. In-turned flanges 54*a*, 54*b*, respectively terminating the lower extremities of third vertical members 34*a* and 34*b*, support and fasten bottom 51. Fourth vertical members 36*a*, 36*b* fasten end member 53*c*. Support assembly 25 is thusly configured to position receptacle 50 in the lower fore portion 24 of apparatus 10 lower than entrance 42.

Receptacle 50 contains a buoyant gate 60 normally disposed in a horizontal position above bottom 51. Suitably a water portal 61 gives access to receptacle bottom 51 when buoyant gate 60 is in a horizontal disposition above bottom 51. Receptacle 50 and buoyant gate 60 are configured to permit water entering through portal 61 to rise beneath buoyant gate 60 and buoy it upwardly from the receptacle toward seat 40. In the depicted embodiment, buoyancy is provided at least in part by float elements 62 on the underside 63 of buoyant gate 60 extending from base 64 to top 65 of buoyant gate 60. Float elements 62 are spaced apart between the sides 66*a*, 66*b* of buoyant gate 60 to allow water entering through portal 61 to rise in receptacle 50 beneath buoyant gate 60 on bottom 51 and buoy buoyant gate upwardly. Once buoyed from receptacle 50, buoyant gate will be buoyed further upwardly by water entering structure 13 from opening 15 until gate 60 inclines about 30-45 degrees from horizontal whence it will tend to close rapidly to engage seat 40, whereupon buoyant gate 60 will block entrance 42 and obstruct water entering structure 13 through opening 15 from passing into passageway 45 and thence into ventilation duct 11, 18. Some water will be initially admitted through entrance 42 and horizontally oriented passageway 45 until closing buoyant gate 60 blocks entrance 42, but that amount of water will be relatively immaterial relative to flooding amounts that are obstructed from entering.

Buoyancy of gate 60 may be provided by any suitable manner such as a honeycombed internal structure, as conceptually indicated by reference numeral 77. Float elements 62 are shown for purposes of illustration of the concept of buoyant construction.

Buoyant gate 60 is sized to have a predetermined height at top 65 to engage seat 40 over margin 41*c*. In an embodiment in which apparatus 10 is to be disposed in the rectangular opening 15 with seat 40 perpendicular to the length, and in which seat 40 is spaced from one of said opposing short sides of rectangular opening 15 by a horizontal distance nominally equal to a fraction applied to the length of the distance separating those two sides, such fraction having a numerator of 1 and a denominator which is the sum of 1 plus the number of seat and gate sets (in the present embodiment, this is one set, so the fraction is 1 over 1+1=2, or ½), buoyant gate 60 may have a seat engagement height nominally equal to the space by which seat 40 is spaced from the short side of the opening 15. Thus, in an embodiment, the height of gate 60 suitably is not more than about half the longest distance in opposing sides of grade level opening 15, and has a seating surface 67 sized to engage seat 40. Seating surface 67 of buoyant gate 60 occupies a periphery 67*a*, 67*b*, 67*c*, 67*d* of buoyant gate 60 adapted to engage seat 40 adjacent inner margins 41*a*, 41*b*, 41*c*, 41*d*. Hinge 68 stationarily mounts to end 52*d* of receptacle 50 and to base 64 of buoyant gate 60 for pivotingly supporting buoyant gate 60 with respect to seat 40.

In an embodiment, a sloped surface declines in a direction away from the vertical seat to flow water introduced through the top opening away from the lower opening. Buoyant gate 60 includes an elevated portion 69 interiorly of peripheral seating surfaces 67*a*, 67*b*, 67*c*, 67*d* declining, i.e., diminishingly tapering as indicated at 70, away from entrance 42 toward seating surface 67*c* which engages seat 40 above margin 41*c* over horizontally oriented entrance 42 responsive to water rising in structure 13. Taper 70 has a slope effective to direct water entering structure 13 including water running off shelf away from entrance 42 and aft portion 23 when buoyant gate 60 is in a horizontal position in receptacle 50, accelerating rise of buoyant gate 60 from receptacle 50. Advantageously, elevated portion 69 has a reverse slope 71 tapering at an obtuse angle 73 from the slope of taper 70, slope 71 tapering toward seating surface 67*d* that engages seat 40 below margin 41*d* when gate 60 is raised to a position closing entrance 42. The obtuse angle 73 for reverse slope 71 moves the maximum height of elevated portion 69 (at the intersection of slopes 70 and 71) further into the fore portion 24 of apparatus 10 away from entrance 42, providing a larger airflow area at entrance 42 than would be the case if the intersection of slopes 70 and 71 described a right angle. The angles depicted in the Figures are merely illustrative of the concept.

When buoyant gate 60 is raised by rising water in structure 13 to engage seat 40, the elevated portion 69 is located interiorly of margins 41 *a*, 41*b*, 41*c* and 41*d* of seat 40, peripheral seating surfaces 67*a*, 67*b*, 67*c*, 67*d* engaging their corresponding seat elements adjacent seat margins 41*a*, 41*b*, 41*c* and 41*d*.

Suitably, receptacle 50 optionally includes a drain 72 to bottom 51 for emptying water from receptacle 50 for connection to any drainage already serving or provided for structure 13 in connection with installation of apparatus 10 in a structure 13.

In an embodiment depicted in FIGS. 7, 7*a* and 7*b*, the upper extremity of support assembly 25 comprises an integrated vent grate 74 configured to fit and sit on lip 16 and thereby hang support assembly 25 in structure 13. Elements in the embodiment depicted in FIGS. 7, 7*a* and 7*b* indicated by reference numbers that are the same element as reference numbers for the embodiment of Fig. Sets 2-6 are the same and perform the same functions as in the embodiments of Fig. Sets 2-6.

In an embodiment depicted in FIGS. 8, 8*a* and 8*b*, support assembly 25 rather than being a framework comprises a surround 75 of walls 75*a*, 75*c*, 75*c* and 75*d* walling apparatus 10 to form an enclosure floored by bottom 51. Elements in the embodiment depicted in FIGS. 8, 8*a* and 8*b* indicated by reference numbers that are the same as reference numbers for the embodiment of Fig. Sets 2-6 are the same element and perform the same functions as in the embodiments of Fig. Sets 2-6. A vent grate 76 configured to fit and sit on lip 16 of grade level opening 15 is integrally fastened atop support assembly 25 to fit and sit on lip 16 and thereby hang support assembly 25 of FIGS. 8, 8*a* and 8*b* in structure 13.

In the example of a rectilinear opening 15 and relatedly rectilinear structure 13, the arrangement of elements in the described embodiments, in which seat 40, secured to a supporting assembly adapted to be placed in structure 13, is secured to be located vertically under opening 15 and perpendicular to and about halfway along the direction of the longest distance in opposing sides of said opening, provides substantially less restrictive impediment to airflow between grade level opening 15 and ventilation ducts 11, 18 for the configuration of the embodiments described in Fig. Sets 2-8. Relatedly, in this rectilinear arrangement, the height or top 65 of buoyant gate 60, located on the fore side of seat 40 distal to ventilation duct 11, 18, is not greater than about half the longest distance in opposing sides of opening 15. In embodiments in which portal 61 is included, height 65 will be enough to provide engagement of seating surface 67*c* with seat 40 above margin 40*c* and still allow space for portal 61. Accordingly, "about half" is used in the sense allowing adjustment accommodation for the particular size of the opening 15 and to provide substantially less restrictive airflow for the configuration of the apparatus in structure 13.

There is thus provided, in accordance with this invention, also a method for obstructing flow of surface water into a ventilation duct communicating from an underground tunnel to a structure below grade level comprising a floor and an opening at grade level having a predetermined configuration and longest distance in opposing sides of the opening. The method comprises providing one or more seating elements 40 around a horizontally oriented passageway 45 extending in a direction of the longest distance in opposing sides of said opening. This location is along that direction where substantially less restriction of airflow between opening 15 and ventilation duct 11, 18 occurs. In an embodiment, this is selected to be about half the longest distance in opposing sides of opening 15, placing seating elements about halfway along the length of the opening. The method further comprises providing a moveable buoyant gate 60 which in an open position permits flow of air between grade level opening 15 and ventilation duct 11, 18 through horizontally oriented passageway 45, and in a closed position is engageable with one or more seating elements 40 to thereby obstruct water, entering structure 13 from grade level opening 15, from flowing into horizontally oriented passageway 45, buoyant moveable gate 60 being in an open position when water level in structure 13 is insufficient to buoy gate 60 upwardly, and being in a closed position when water level in structure 13 is sufficiently high to buoy gate 60 to engage seating elements 40. The method advantageously further comprises providing one or more normally closed pivotally mounted shutters 46 above horizontally oriented passageway 45 openable by air pressure in passageway 45 in excess of fluid pressure in structure 13 above shutters 46 when gate 60 is in closed position. Further advantageously, the method comprises providing seating surface 67 on a periphery of buoyant gate 60 for engaging the one or more seating elements 40, buoyant gate 60 including an elevated portion 69 interiorly of that periphery tapering diminishingly toward a seating surface 67*c* which engages seat 40 above margin 41*c* over entrance 42 responsive to water rising in structure 13, taper 70 having a slope effective to direct water entering structure 13 from grade level opening 15 away from entrance 42 when gate 60 is in open position.

The Embodiment of FIGS. 9-24

Turning now to the embodiment described in FIGS. 9-24, another embodiment is packaged for below grade fitment in a rectangular street level subway opening 15, as an example. In an embodiment described, the gates may close and open about a pivotation axis that is parallel to the longest distance of the surface opening 15, i.e., for a subway system such as the New York City, where the street level grated openings typically are rectangular and oriented with the long dimension running in the direction of the adjacent street, the pivotation axis is parallel to the direction of the adjacent street and curb.

In the embodiment of FIGS. 9-24, a plurality of seat and gate sets are employed. As will be understood from the detailed description of this embodiment that follows, this arrangement allows for an efficient packaging providing improved airflow through the unit compared to a single seat and gate set.

Referring especially to FIGS. 9, 10, 11 and 12, apparatus 100 for preventing downward flow of substantial surface water into an underground ventilation duct 11 communicating upwardly to a ground surface opening 15 is depicted. Apparatus 100 comprises a support in the form of an enclosure 101 adapted to locate in an upward opening of an underground enlargement 13 of a ventilation duct 11 to a tunnel 12 or other underground cavity. Enclosure 101 includes a floor 102, a top opening 103, opposed side walls 104 and 105, and opposed first and second end walls 106 and 107, respectively, between side walls 104, 105. Second end wall 107 terminates above floor 102 to form an opening 108 between lower portion 109 of second end wall 107 and floor 102. The walls 104, 105, 106 and 107 and floor 101 are connected, as by welded joinder, to form the enclosure. Opening 108 in lower portion 109 is arranged for venting communication with a proximate portion of ventilation duct 11 below ground surface opening 15. For convenience of description and clarity with respect to orientation, second end wall 107 sometimes will be called front wall 107, as it will front toward the adjacent curb and street and opening 108 would front into the portion of the ventilation system under ground surface opening 15, for example, in a discharge structure 13 of the ventilation duct. Conversely, first end wall 106 opposite front wall 107 sometimes will be called back wall 106.

Enclosure 101 is adapted to nest within surface opening 15. As depicted surface opening 15 is rectangular. Flange 111 is welded to and spans the length of the top of side wall 104 and flange 112 is welded to and runs the length of the top of side wall 105. Flanges 111 and 112 fit on lips 16 of the shorter opposing side of rectangular ground (surface) opening 15 for nesting enclosure 101 in opening 15, for location in the portion of the ventilation system under ground (surface) opening 15, for example, in a discharge structure 13, and to support a grate 113 (shown only in outline in FIG. 9, to avoid obscuring other features) covering grade or surface level opening 15. As mentioned the front wall 107 is nearest the curb adjacent to opening 15.

Located within enclosure 101 are a plurality of supported seat and gate sets. Each set includes a buoyant gate assembly. A first buoyant gate assembly 114 and a second buoyant gate assembly 115 are arrayed in enclosure 101.

Enclosure 101 supports a shelf 116 at least a portion 117 of which is under at least a portion of top opening 103 and above lower opening 109 for shielding lower opening 109 from water introduced through at least the portion of top opening 109 over shelf 116. In an embodiment, a sloped surface 118, 119 declines in a direction away from vertical seat 121 to flow water introduced through top opening 103 away from lower opening 109. In an embodiment, sloped surface 118, 119 comprises part of shelf 116. In an embodiment, shelf 116 comprises a trough portion 117 emptying into sloped portion 118, 119.

More particularly, above upper buoyant gate assembly 115, shelf 116 comprises a horizontal trough 117 and a bipartite sloped surface 118, 119. Trough 117 comprises a plate 120 laterally welded to side walls 104, 105 and welded to an upper portion of front wall 107 below top opening 103. On the end of plate 120 opposite the end that is welded to front wall 107, a downwardly vertical flange 121 is welded along the span of plate 120 between side walls 104, 105. Flange 121 provides the seat 121 for the gate of upper gate assembly 115.

Sloped surface part 118 is a plate welded to side wall 104 and flange 121. Sloped surface plate part 119 is a welded to side wall 105 and to flange 121. Welded atop trough plate 120, spaced from side walls 104, 105 and spaced from front wall 107, is a vertical baffle 122 having a center part 123 and end parts 124, 125 obtusely angled to center part 123. Center part 123 is set back from the edge of plate 120 where flange 121 is affixed, such that the extremities of end parts 124, 125 distal from center part 123 terminate at that edge. Front wall 107, side walls 104 and 105, plate 120 and baffle 122 form trough 117. Welded atop sloped surface plate 118, spaced from sidewall 104 and extending from the extremity of baffle end part 124 to the end 126 of plate 118 distal to baffle 122 is vertical runner 127. Welded atop sloped surface plate 119, spaced from sidewall 105 and extending from the extremity of baffle end part 128 to the end 126 of plate 119 distal to baffle 122 is vertical runner 128. Plate 118 bounded by sidewall 104 and runner 127 forms chute 129, and plate 119 bounded by sidewall 105 and runner 128 forms chute 130.

With front wall 107 facing in the direction of an adjacent curb, water flooding over the curb will enter trough 117, drain through chutes 129, 130 and waterfall vertically to floor 102, with any horizontal component of the rush from chutes 129, 130 confined by back wall 106 and splashing to the bottom of enclosure 101 in which the water is confined. Thus, shelf 166 comprising trough 117 and chutes 129, 130 on bipartite sloped surface 118, 119 direct entering water away from lower opening 108 and the proximate portion of the ventilation duct.

The horizontal space area under top opening 103 and separating vertical flange 121 and the edges 126 of shelf surfaces 118, 119 from back wall 106 is open, and projected vertically downwardly in enclosure 101 is a vertical zone 131 (See FIGS. 13 and 23) through which water admitted through top opening 103 falls and which provides access to air flow communication to top opening 103 until enclosure 101 is filled with water (about which more is explained below). Rain entering through grated vent opening 15 also falls into enclosure 101 through this spatial area separating vertical flange 121 and the edges 126 of shelf surfaces 118, 119 from back wall 106, but in a flooding condition entering rainfall is dwarfed by the volume of ponding water pouring over an adjacent curb into trough 117 and chuted toward back wall 106 and into the bottom of enclosure 101. Referring to FIG. 12, it will be seen that edges 126 of chutes 129, 130 extend horizontally past the end 140 of lower gate 136 of gate assembly.

As mentioned, enclosure 101 supports a plurality of paired seat and buoyant gate sets. A first set includes first buoyant gate assembly 114, and a second set includes second buoyant gate assembly 115. First buoyant gate assembly 114 occupies a lower position in enclosure 101 than second buoyant gate assembly 115, and for clarity is sometimes called lower buoyant gate assembly 114; higher second buoyant gate assembly 115 is sometimes called upper buoyant gate assembly 114. In the embodiment of FIG. 9, upper buoyant gate assembly 115 is horizontally offset toward lower portion opening 108 from the lower buoyant gate assembly 114 next below it. Offset is a matter of the vertical space within enclosure 101 available to fit seat and gate sets, and is illustrated to show how a plurality of stacked seat and gate sets can be deployed when vertical space below the grade opening 15 does not allow one set to be stacked directly over the other. Where these constraints are not present, the sets may be vertically arrayed over each other, in which case the seats for each lower set may be located as described for the seat of the uppermost set.

The seat of upper gate assembly is seat 121. The seat of the lower gate assembly, further described below, is seat 178. Each seat 121, 178 may be located for less restriction of airflow through enclosure 101. In the orientation of the embodiment depicted in FIGS. 9, 10, 23 and 24, enclosure front wall 107 vertically underlies the longer opposing side of rectangular surface opening 15 next to an adjacent curb. Less restrictive air flow is achieved by spacing the highest seat (here, 121) from front wall 107 a horizontal distance nominally equal to a fraction applied to the length of the distance separating the long sides of rectangular opening 15. The fraction has a numerator of 1 and a denominator that is the sum of 1 plus the number of seat and gate sets. In this embodiment the number of sets is two, so the fraction is 1 over 1+2=3, or ⅓. Accordingly, in an arrangement of the embodiment disposed in a rectangular opening 15 in which seat 40 is parallel to the length of the rectangular opening, the location of upper seat 121 may be spaced from front wall 107 about ⅓ the distance separating the opposing long side sides of rectangular opening 15, that is, about ⅓ the width of rectangular opening 15 of structure 13. For example, if the opening 15 is rectangular and is five feet long by four feet wide, and if enclosure 101 is to be disposed in the rectangular opening with seat 121 parallel to the length, enclosure 101 would be constructed such that seat 121 would be placed about ⅓ of 4 feet (1⅓ feet or 16 inches) from the long side next to the adjacent curb.

In the set offset configuration depicted in FIGS. 9, 10, 23 and 24, in which there are a plurality of vertically arrayed sets 114 and 115 and in which the higher set 115 is horizontally offset from the set 114 next below it and toward lower portion opening 108, for less restrictive airflow seat 121 of the uppermost set being spaced from one of the opposing sides a distance nominally equal to the fraction applied to a fixed length (the length of the distance separating the long sides of rectangular opening 15 in this case), for less restrictive airflow the seat of the next lower set 114 may be spaced from one of the opposing sides a distance nominally equal to the fraction applied to that fixed length multiplied by the sum of 1 plus the number of sets above it. In this case, there is one set above set 114, so the sum is 2. Therefore, lower seat 178 would be spaced from front wall 107 by twice the distance seat 121 is. Another way to say this is that lower seat 178 is spaced horizontally from upper seat 121 by essentially the same distance as seat 121 is spaced from front wall 107. These two ⅓ widths of opening 15 add to give an airflow through enclosure 101 that is 66% of the airflow from the ventilation duct to the surface opening 15 absent the presence of enclosure 101 interposed between the ventilation duct and surface opening 15. As mentioned in the case of the embodiment of Fig. Sets 2-8, packaging limitations for specific sites often involve some compromise, so the term "nominal" signifies that if the less restrictive location is to be used, a seat of a set is placed as reasonably near the location indicated by application of the fraction to the selected distance in the opening 15 as practical packaging and other constraints allow.

As mentioned, a plurality of gates may be arrayed vertically without offset. In such instance each seat of a set may be spaced from one of said opposing sides a distance nominally equal to said fraction applied to the mentioned fixed length.

Lower buoyant gate assembly 114 is depicted in top plan view in FIG. 13 and in sectional view in FIG. 16. Upper gate assembly 115 is depicted in top plan view in FIG. 14 and in cross sectional view in FIG. 15. Views in the directions of arrows 17 in FIGS. 13 and 14 show details common to lower and upper gate assemblies, about which more is described below.

A space above upper buoyant gate assembly 115 and below seat 121 and trough plate 120 and provides a first horizontal passageway 132 from zone 131 to lower opening 108. Horizontal passageway 132 fluidly communicates top opening 103 to the proximate portion 13 of ventilation duct 11 at opening 108 between front wall 107 and floor 102 of enclosure 101. This passageway under seat 121 above upper buoyant gate assembly 115 is sometimes called upper passageway 132. When the gate of upper buoyant gate assembly 115 is not seated on upper seat 121 (about which more below), air from tunnel 12 venting through ventilation duct 11 and discharge structure 13 flows through opening 108 and upper passageway 132 through vertical zone 131 to top opening 103; and vice versa, air from top opening 103 flows through vertical zone 131 to and through upper horizontal passageway 132 out opening 108 and through discharge structure 13 and ventilation duct 11 into tunnel 12.

A space over under upper buoyant gate assembly 114 and above lower buoyant gate assembly 114 provides a second horizontal passageway 133 from vertical zone 131 to opening 108 also fluidly communicating top opening 103 to the proximate portion 13 of ventilation duct 11 at opening 108 between front wall 107 and floor 102 of enclosure 101. This passageway over lower buoyant gate assembly 114 is sometimes called lower passageway 133. When the buoyant gate of gate assembly 114 is not seated on its paired seat (about which, more below), air from tunnel 12 venting through ventilation duct 11 and discharge structure 13 flows through opening 108 and lower passageway 133 through vertical zone 131 to top opening 103; and vice versa, air from top opening 103 flows through vertical zone 131 to and through lower horizontal passageway 133 out opening 108 and through discharge structure 13 and ventilation duct 11 into tunnel 12. When lower passageway 133 is open, so also will be upper passageway 132, for the buoyant gate of upper gate assembly 115 does not elevate to close onto seat 121 until lower passageway 133 is blocked, as described below, to prevent water poured into enclosure 101 from passing through lower passageway 133 past opening 108 into discharge structure 13, thence to ventilation duct 11.

Referring to FIGS. 9, 10 and 16, at the base of enclosure 101, a pan 134 comprising a vertical plate 135 attached to a horizontal plate 102 is welded at its sides to side walls 104, 105. Plate 102 forms floor 102 of enclosure 101. Side walls 104, 105 and pan 134 inclusive of vertical plate 135 and floor 102 form the bottom of enclosure 101. Water dropping through vertical zone 131 falls onto floor 102 in pan 134.

Referring now particularly to FIGS. 13-22, buoyant gate assemblies 114 and 115 are detailed. Lower buoyant gate assembly 114 is particularly depicted in FIG. 16. Lower buoyant gate assembly 114 comprises a buoyant gate 136 having a top plate 137, bottom plate 138, side plates 139, front end plate 140 and back end plate 141. Top plate 136 of gate 136 is of a size to block the lower horizontal passageway 133 when buoyant gate 136 is elevated. Buoyancy of gate 136 may be provided by any suitable manner such as a honeycombed internal structure or such as a fill with a high density closed cell foam 110 (as indicated schematically at 110 in FIG. 18 where a portion of side 139 is shown removed to reveal the interior and as indicated in FIG. 17 where a portion of gate back end 141 is also shown removed for the same purpose). Closed cell foam 110 is also depicted schematically in cross section illustrations of FIGS. 15, 16 and 19. Closed cell foam 110 gives gate 136 a lower specific gravity than an equal volume of water, and hence buoyancy.

FIGS. 20-22 depict one of the hinge assemblies 151, 152, 153 employed for pivotally mounting lower buoyant gate 136 to pan 134 that forms the bottom of enclosure 101. Left and right hinge pin mounting ears 142, 143, respectively, are welded to vertical plate 135 of pan 134. Hinge arm 144 is received between mounting ears 142, 143 and accepts hinge pin 145 inserted through a bore in arm 144 and corresponding bores in mounts 142, 143. Washers 146, 147 on each side of arm 144 control lateral play in the space between arm 144 and ears 142, 143. Hinge pin 145 is secured in ears 142, 142 by C-clips 148, 149. Arm 144 is affixed at its end distal from ears 142, 143 to a plate 150. Plate 150 is welded to top plate 137 of lower buoyant gate 136. As seen in FIG. 9, a plurality of hinge assemblies 151, 152 and 153 pivotally support lower buoyant gate 136 in pan 135 such that buoyant gate 136 can rotate out of pan 134.

A gasket 154 suitably of EPDM rubber (ethylene propylene diene M-class rubber) material is affixed to the inner side of vertical plate 135 of pan 134 and to buoyant gate top plate 137 to seal gate 136 to the interior of pan 134 so that water rising in pan 134 does not escape pan 134 and spill over the top of vertical plate 135 and pass into opening 108. Referring to FIG. 19, vertical plate 135, gasket 154 and pan strap 155 are drilled in a plurality of places along their lengths. Gasket 154 is sandwiched between pan strap 155 and vertical plate 135 with their drilled bores in alignment, and pan strap 155 is secured to vertical plate by counter sunk bolts 156 with a lock nut, holding gasket 154 between them. Gasket 154 is secured to buoyant gate top plate 137 adjacent vertical plate 135 in a similar fashion, using pressure strap 157 which runs the length of gate 136 and which is fastened through top plate 137 to backing plate 158 by counter sunk bolts 159 and lock nut. Backing plate 158 also runs the full length of gate 136 but on the underside of top plate 137.

Referring to FIGS. 13 and 17, gasket 154 is also affixed to the lateral ends of top plate 137 similarly as it is at the end of top plate 137 adjacent vertical plate 135 of pan 134, by straps 160, 161 and bolts 162. The portions of gasket 154 fixed on both sides of buoyant gate 136 by side straps 160, 161 seal the space between the sides of gate 136 and side walls 104, 105 of enclosure 101, so water rising in pan 134 and causing gate 136 to buoyantly elevate rotationally about hinge pin 145 does not flow around the sides of gate 136 and escape to opening 108 through the space separating the sides of gate 136 and side walls 104, 105.

Referring to FIG. 15, upper buoyant gate assembly 115 is depicted. Pan 163 of upper buoyant gate assembly 115 it is similar in all respects to pan 134 of lower buoyant gate assembly 114 except lower plate 164 of upper pan 163 normal to vertical plate 165 is shorter than the lower plate 102 of pan 134 forming floor 102. Pan 163 is welded at its plate 164 and 165 sides to side walls 104, 105. Similarly, upper plate assembly includes a gate 166 with a top plate 167, bottom plate 168, side plates 169, front end plate 170 and back end plate 171. Top plate 167 of buoyant upper gate 166 is of a size to block the upper horizontal passageway 132 when buoyant upper gate 166 is elevated. Upper gate 166 is filled with high density closed cell foam 110 for buoyancy, as is gate 136. Upper gate 166 is pivotally mounted as is gate 136, on upper gate hinge assemblies 171, 172 and 173, which are structurally the same as lower hinge assemblies 151, 152, and 153 and have the same reference numbers as used for the hinge assembly components described in FIGS. 20-22 and FIG. 16 for hinge assemblies 151, 152, 153. Gate 166 and upper pan 163 are sealed from water bypass by a gasket 175, as are lower gate 136 and lower pan 134.

A flange 176 extends the length of lower plate 164 of upper pan 163 and is welded on its upper arm 177 to the end of lower plate 164 remote from vertical plate 165 of pan 163. The vertical free arm 178 of flange 176 forms a seat 178 for lower buoyant gate 136. Seat 178 and buoyant gate 136 are a set for operation to block flow of water through lower passageway 133. Seat 178 is mounted vertically relative to the portion of horizontal lower passageway 133 under seat 178 that fluidly communicates beyond such portion to top opening 103 and to the proximate portion 13 of ventilation duct 11. Upper buoyant gate 166 is part of a seat and buoyant gate set of which the vertical part of flange 121 affixed under shelf 116 is seat 121.

Thus as explained, in the embodiment of FIGS. 9-22, enclosure 101 has a plurality of buoyant gate and seat sets vertically arranged in the enclosure. Although only two sets are disclosed, more than two sets may be employed as appropriate for the enclosure dimensions and the space within which the enclosure package is sized to fit. In general, it is functionally advantageous to employ a plurality of sets and as many sets of seats and buoyant gates as feasible for the vertical space available, for two reasons, the more important of which is that doing so increases the air flow capacity of enclosure 101.

Airflow is limited by the smallest opening through which the air travels. In the ventilation system depicted in FIG. 1, a ventilation duct 11, 18, 13 terminates at surface 14 in an upward opening 15 that limits airflow in and out of the duct. As such, airflow through a given gate and seat set is maximized when the height of the closure entrance is equal to the length of the passageway in front of it under the surface opening 15. In a system with a single gate and seat set, such as shown in Fig. Sets 2-8, this maximum arrangement is achieved when the gate height (entrance 42) and the passageway 24 are each about one half of the size of the opening 15. Such an arrangement, allows for about 50% of the original airflow. When two gate and seat sets are employed, such as in FIG. 9, the maximum arrangement is achieved when each gate height is about one third (⅓ or 33%) of the size of the opening 15. In the arrangement depicted in FIG. 9, and referring particularly to FIGS. 10, 23 and 24 and to upper seat and gate set of gate assembly 115, seat 121 is located at a point nominally ⅓ along the length of surface opening 15 (measured from the surface opening edge above the lower opening 108 that is proximate the ventilation duct) and the nominal erect height of the closure provided by gate 166 (measured from the pivot of pivotation mount 174 on vertical plate 165 of pan 163) is also about ⅓ the so measured length of surface opening 15. Referring to the lower seat and gate set of gate assembly 114, seat 178 is located at a point nominally ⅔ along the so measured length of surface opening 15 and the nominal erect height of gate 136 (measured from the pivot of pivotation mount 153 on vertical plate 135 of pan 134) is also about ⅓ the so measured length of surface opening 15. Thus the horizontal air passage length of the space in enclosure 101 in front of seat 121 is nominally ⅔ the length of surface opening 15, and the horizontal air passage length in the space in enclosure 101 in front of seat 178 is nominally ⅓ the length of surface opening 15. This arrangement of two gate and seat sets allows for nominally 66% of the original airflow (33% between upper gate assembly and its paired seat 121 and 33% between lower gate assembly 114 and its paired seat 178). In arrangements where more gate and seat sets are employed, the airflow allowed increases accordingly (for instance, three gate and seat sets allow nominally 75% of the airflow). However, practical matters such as increased number of moving parts, complexity, maintenance requirements, and airflow loss due to bracketry and material thicknesses limit the reasonable number of gate and seat sets that can practically be employed.

Another reason for employing a plurality of seats is because air flow through the enclosure to the ventilation system can maintained longer during flooding conditions as the number of seat and buoyant gate sets increases. This is because each set establishes an additional horizontal passageway under a seat of a set (like passageways 132, 133) that can be kept open as lower horizontal passageways are closed off by action of lower buoyant gates as water rises in the enclosure.

Thus as respects the set of lower buoyant gate 136 and its paired seat 178, buoyant gate 136 including its pivotation mount is positioned lower than its seat 178 and lower than lower horizontal passageway 133 (which is between lower buoyant gate 136 and its companion seat 178). In normal condition when no flooding is occurring, buoyant gate 136 is normally disposed horizontally. As depicted schematically in FIG. 23, buoyant gate 136 is responsive to water rising in pan 134 of enclosure 101 by floatingly pivoting upwardly on hinge pins 145 of hinge assemblies 151, 152 and 153, until gate 136 engages seat 178 on an end portion of top plate 137 of buoyant gate 136 distal to lower buoyant gate hinge assemblies 151-153. Buoyant gate 136, as mentioned, is of a size to block lower horizontal passageway 133 when engaged on seat 178.

As respects the paired set of upper buoyant gate 166 and its seat 121, buoyant gate 166 including its pivotation mount is positioned lower than its seat 121 and upper horizontal passageway 132 under seat 121. In normal condition when no flooding is occurring, or if as depicted in FIG. 23 there is flooding but flooding into enclosure 101 has not yet reached the level of upper pan 163, buoyant gate 166 is normally disposed horizontally and venting through upper passageway 132 continues. As depicted in FIG. 24, buoyant gate 166 is responsive to water rising in pan 163 in enclosure 101 by floatingly pivoting upwardly on hinge pin 145 of hinge assemblies 172, 173, 174 until vertically engaging seat 121 on an end portion of top plate 167 of buoyant gate 167 distal to upper buoyant gate hinge assemblies 172-174. Buoyant gate 166, as mentioned, is of a size to block upper horizontal passageway 132 when engaged on seat 121. As seen by the elevations of lower and upper buoyant gates 136, 166 in FIG. 24, in full blocking state, floodwater is not able to access lower opening 108 to get to ventilation duct 11.

Operationally, when no flooding situation is occurring, enclosure 101 acts to allow free flow of air between top opening 103 and lower opening 108 proximate discharge structure 13 and then through ventilation duct 11 into tunnel 12, and vice versa. When waters pour into top opening 103, they are collected in trough 117 and chuted through chutes 129, 130 into a portion of vertical zone 131 between the front end 140 of lower gate 136 and back wall 106 where they fall to the bottom of enclosure 101, run under pan 134 and rise in pan 134 of lower buoyant gate assembly 114, prevented from escaping pan 134 into lower opening 108 by gasket 154. As water rises in pan 134, buoyant gate 136 elevates pivotingly on hinge pin 145 of hinge assemblies 151, 152 and 153. The rate of rise is rapid for amount of water pouring into enclosure 101 in a street flooding situation is voluminous. Gate 136 rises until it engages seat 178, closing lower passageway 133 while leaving an air passage through upper passageway 132. In a street flooding condition, water will continue to pour rapidly into enclosure 101, and upper buoyant gate 166 will quickly buoyantly elevate as did lower buoyant gate 136 and, until engaging seat 121, will continue to allow air to pass through upper passageway 132, closing upper passageway 132 when upper buoyant gate 166 engages seat 121.

Enclosure 101 is fitted with a weep drain 179 in floor 102. Drain 178 is connected to drainage piping of ventilation duct 11, which in turn flows into the subway pumping system. Water accumulating in enclosure 101 is continually metered through drain 178 into the subway pumping system. As storm rain subsides and storm sewers eventually are no longer fully charged and can begin to accept water from flooded streets lowering the street ponds below curb level, the water captured in enclosure 101 and prevented from entering ventilation duct 11 will drain through weep drain 179, buoyant gate 166 will disengage from seat 121, air flow through upper passageway 132 will resume (until as in FIG. 23, where buoyant gate 166 is fully lowered and air passageway 132 is fully opened), and as drainage continues, buoyant gate 136 will disengage from seat 178 allowing air flow to resume in lower passageway 133.

A brace 180 spanning side walls 104, 105 adds structural rigidity to enclosure 101.

It will be seen therefore, that there is provided a method of preventing downward flow of substantial amounts of surface storm water into an underground ventilation duct communicating upwardly to a surface opening, comprising (i) interposing, between surface opening 15 and ventilation duct 11, a chamber or enclosure 101 upwardly open at 103 in fluid communication with surface opening 15 and opening at 108 in a lower portion of the enclosure for venting communication through enclosure 101 with a proximate portion 13 of ventilation duct 11; (ii) providing at least one set of at least one seat 178 (and if a plurality of sets, e.g., seat 121) and at least one buoyant gate 136 (and if a plurality of sets, e.g., buoyant gate 165) in enclosure 101, each seat being mounted vertically relative to a horizontal portion of a passageway under the seat for fluidly communicating beyond such horizontal portion to the top opening 103 and to the proximate portion 13 of ventilation duct 12, each buoyant gate including a pivotation mount and being positioned lower than the seat and the passageway, being normally disposed horizontally, being of sufficient size to block the passageway, and being responsive to water rising in the enclosure by floatingly pivoting upwardly until vertically engaging the seat on at least an end portion of the buoyant gate distal to the pivotation mount, blocking the passageway, such enclosure holding water when a buoyant gate of a set engages a seat of a set, the enclosure allowing ventilation between the top opening and the ventilation duct so long as rising water in the enclosure has not closed every buoyant gate on every seat in every set.

There is also provided, as explained in application to the several embodiment described above, a method for providing less restrictive airflow through a support structure interposed in a underground ventilation duct system between a ventilation duct and a surface opening of the ventilation duct to prevent downward flow of substantial amounts of surface water into the ventilation duct, the support structure having a top opening for fluid communication with the surface opening, a support floor, and an opening in a lower portion of the support higher than the support floor for fluid communication with a proximate portion of the ventilation duct, the surface opening having a fixed length between selected opposing sides of the opening. The method comprises providing in the structure one or more sets each comprising a seat and a paired buoyant gate normally disposed perpendicular to the seat, arranging each the set in the support to provide airflow from the lower portion opening to the surface opening that is a nominal fraction of the airflow from the ventilation duct to the surface opening absent presence of the apparatus, the fraction having the numerator 1 and a denominator which is the sum of 1 plus the number of the sets, the seat of at least one set being mounted under the top opening spaced from one of the opposing sides a distance nominally equal to the fraction applied to the fixed length, the buoyant gate of a set having a seat engagement height nominally equal to the fraction applied to the fixed length, being positioned lower than the seat, and responsive to water rising in the support by floatingly upwardly until engaging the seat and blocking passage for air flow under the seat.

In one application of this method, when there are a plurality of spaced vertically arrayed sets, each seat of a set is spaced from one of the opposing sides a distance nominally equal to the fraction applied to the fixed length. In another application of this method, in which there are a plurality of vertically arrayed sets and in which each higher set is horizontally offset from the set next below it and toward the lower portion opening, the seat of the uppermost set is spaced from one of the opposing sides a distance nominally equal to the fraction applied to the fixed length, and each seat of a next lower set is spaced from one of the opposing sides a distance nominally equal to the fraction applied to the fixed length multiplied by the sum of 1 plus the number of sets above it, the buoyant gate having a seat engagement height As has been explained, embodiments of the invention prevent substantial amounts of water from entering the ventilation ducts of ventilation systems of underground chambers and tunnels or other underground structures having a ventilation duct. The expression "substantial amounts" is used merely to avoid the impression that the arrangement of elements in the embodiments entirely prevents water from gaining entrance into the ventilation system. As described in the case of subways, extant subway pump systems can hand handle some water gaining entrance into ventilation ducts from rainfall, but can be overwhelmed by substantial amounts of water entering the system as can occur when storm sewers are fully charged and surging causing street flooding to override curbs and pour through sidewalk grated subway vent openings. In the embodiments, there will be some leakage around seals and by seats but substantial amounts of water will be prevented from entering the ventilation system.

The above disclosed subject matter is to be considered illustrative, and not restrictive, and the appended claims are intended to cover all modifications, enhancements, and other embodiments that fall within the true scope of the present invention, which to the maximum extent allowed by law, is to be determined by the broadest permissible interpretation of the following claims and their equivalents, unrestricted or limited by the foregoing detailed descriptions of embodiments of the invention.

The invention claimed is:

1. Apparatus for preventing downward flow of substantial amounts of surface water into an underground ventilation duct communicating upwardly to a surface opening having a fixed length between opposing sides of the opening, comprising:

a support having a top opening for fluid communication with said surface opening, a support floor, and an opening in a lower portion of the support higher than the support floor for fluid communication with a proximate portion of said ventilation duct, said support supporting one or more sets each comprising a seat and a paired water buoyant gate disposed to rotate upwardly toward said seat, each said set being arranged in said support to provide airflow from said lower portion opening to said surface opening that is a nominal fraction of the airflow from said ventilation duct to said surface opening absent presence of said apparatus, said fraction having the numerator 1 and a denominator which is the sum of 1 plus the number of said sets, the seat of at least one set being mounted under said top opening spaced from one of said opposing sides a distance nominally equal to said fraction applied to said fixed length, said buoyant gate having a seat engagement height nominally equal to said fraction applied to said fixed length, being positioned lower than said seat, and responsive to water rising in said support by floatingly upwardly until engaging said seat and blocking passage for air flow under said seat.

2. The apparatus of claim 1 in which there are a plurality of spaced vertically arrayed sets, each seat of a set being spaced from one of said opposing sides a distance nominally equal to said fraction applied to said fixed length.

3. The apparatus of claim 1 in which there are a plurality of vertically arrayed sets and in which each higher set is horizontally offset from the set next below it and toward said lower portion opening, the seat of the uppermost set being spaced from one of said opposing sides a distance nominally equal to said fraction applied to said fixed length, and each seat of a next lower set being spaced from one of said opposing sides a distance nominally equal to said fraction applied to said fixed length multiplied by the sum of 1 plus the number of sets above it, said buoyant gates having a seat engagement height nominally equal to said fraction applied to said fixed length for the uppermost set.

4. The apparatus of claim 1 in which said one or more sets comprise a vertically mounted seat and a paired normally horizontally disposed buoyant gate.

5. Apparatus for preventing downward flow of substantial amounts of surface water into an underground ventilation duct communicating upwardly to a surface opening, comprising:

a support having a top opening for fluid communication with said surface opening, a support floor, and a lower opening in a portion of the support lower than the top opening and higher than the support floor for fluid communication with a proximate portion of said ventilation duct, said support supporting one or more sets each comprising a vertically mounted seat and paired water buoyant gate;

said seat upwardly demarcating in said set, on a side of the seat proximate said ventilation duct, at least one proximate passageway portion for fluid communication with said ventilation duct through said lower opening, and demarcating, on an opposite side of the seat, at least one distal passageway portion distal from said lower opening in fluid communication with said top opening of said support, said buoyant gate including a pivotation mount and being:

positioned lower than said seat in said set, normally disposed horizontally, of sufficient size to block said proximal passageway portion, and responsive to water rising in said support by floatingly pivoting upwardly until engaging said seat on at least an end portion of the gate distal to said pivotation mount, blocking said proximate passageway portion.

6. The apparatus of claim 5 in which said surface opening has a fixed length between opposing sides of the opening and each said set is arranged in said support to provide airflow from said lower portion opening to said surface opening that is a nominal fraction of the airflow from said ventilation duct to said surface opening absent presence of said apparatus, said fraction having the numerator 1 and a denominator which is the sum of 1 plus the number of seat and gate sets, the seat of at least one set being mounted under said top opening spaced from one of said opposing sides a horizontal distance nominally equal to said fraction applied to said fixed length, said buoyant gate having a seat engagement height nominally equal to said fraction applied to said fixed length.

7. The apparatus of claim 5 comprising a sloped surface within said support declining in a direction away from said seat to flow water introduced through said top opening away from said lower opening.

8. The apparatus of claim 5 in which said support supports a shelf at least a portion of which is under at least a portion of said top opening and above said lower opening for shielding said lower opening from water introduced through at least said top opening portion over said shelf.

9. The apparatus of claim 8 comprising a sloped surface declining in a direction away from said vertical seat to flow water introduced through at least said top opening portion over said shelf away from said lower opening.

10. The apparatus of claim 9 in which said sloped surface comprises part of said shelf.

11. The apparatus of claim 10 in which said shelf comprises a trough portion emptying into said sloped portion.

12. The apparatus of claim 5 comprising a plurality of said sets vertically arranged in said support.

13. The apparatus of claim 12 in which each said set is arranged in said support to provide airflow from said lower portion opening to said surface opening that is a nominal fraction of the airflow from said ventilation duct to said surface opening absent presence of said apparatus, said fraction having the numerator 1 and a denominator which is the sum of 1 plus the number of seat and gate sets, each seat of a set being spaced from one of said opposing sides a horizontal distance nominally equal to said fraction applied to said fixed length, said buoyant gate having a seat engagement height nominally equal to said fraction applied to said fixed length.

14. The apparatus of claim 12 in which each higher set is horizontally offset from the set next below it and toward said lower portion opening.

15. The apparatus of claim 14 in which the seat of the uppermost set is spaced from one of said opposing sides a distance nominally equal to said fraction applied to said fixed length, and each seat of a next lower set is spaced from one of said opposing sides a distance nominally equal to said fraction applied to said fixed length multiplied by the sum of 1 plus the number of sets above it, said buoyant gate having a seat engagement height nominally equal to said fraction applied to said fixed length for the uppermost set.

16. The apparatus of claim 5 in which said support comprises an enclosure.

17. Apparatus of claim 16 in which said enclosure comprises opposed side walls, opposed first and second end walls between the side walls, and a floor, the second end wall terminating higher than the floor to form said lower portion opening, said walls and floor being joined and holding water when a gate of a set engages a seat of a set, said apparatus allowing ventilation between said top opening and said ventilation duct so long as rising water in said enclosure has not closed the gate on the seat in every set.

18. The apparatus of claim 17 in which said support supports a shelf at least a portion of which is under at least a portion of said top opening and above said lower opening for shielding said lower opening from water introduced through at least said top opening portion over said shelf.

19. The apparatus of claim 17 comprising a sloped surface declining in a direction away from said vertical seat to flow water introduced through at least said top opening portion over said shelf away from said lower opening.

20. The apparatus of claim 19 in which said shelf comprises a trough portion emptying into said sloped portion.

21. The apparatus of claim 17 comprising a plurality of said sets vertically arranged in said support.

22. The apparatus of claim 21 in which each said set is arranged in said support to provide airflow from said lower portion opening to said surface opening that is a nominal fraction of the airflow from said ventilation duct to said surface opening absent presence of said apparatus, said fraction having the numerator 1 and a denominator which is the sum of 1 plus the number of seat and gate sets, each seat of a set being spaced from one of said opposing sides a horizontal distance nominally equal to said fraction applied to said fixed length, said buoyant gate having a seat engagement height nominally equal to said fraction applied to said fixed length.

23. The apparatus of claim 21 in which each higher set is horizontally offset from the set next below it and toward said lower portion opening.

24. The apparatus of claim 23 in which the seat of the uppermost set is spaced from one of said opposing sides a distance nominally equal to said fraction applied to said fixed length, and each seat of a next lower set is spaced from one of said opposing sides a distance nominally equal to said fraction applied to said fixed length multiplied by the sum of 1 plus the number of sets above it, said buoyant gate having a seat engagement height nominally equal to said fraction applied to said fixed length for the uppermost set.

25. The apparatus of claim 23 in which the seat of a next lower set is formed on a support portion for the gate of the next higher set distal to the pivotation mount of the gate of such next higher set.

26. The apparatus of claim 16 in which said enclosure is adapted to nest within said ground surface opening.

27. Apparatus for preventing downward flow of substantial amounts of surface water into an underground ventilation duct communicating upwardly to a ground surface opening, comprising:

an enclosure comprising a floor, a top opening, opposed side walls, and opposed first and second end walls between the side walls, the second end wall terminating higher than the floor to form an opening in a lower portion of the enclosure, said walls and floor being joined, said enclosure being adapted to nest within said surface opening, said opening in said lower portion being situated for ventilation communication with a proximate portion of said ventilation duct, said enclosure supporting:

a plurality of paired seat and water buoyant gate sets, each seat being mounted vertically relative to a portion of a passageway under said seat for fluidly communicating beyond such portion to said top opening and to said lower opening, each said buoyant gate including a pivotation mount and being positioned lower than said seat in the set of which it is part, being normally disposed horizontally, being of sufficient size to block said passageway portion, and being responsive to water rising in said enclosure by floatingly pivoting upwardly until engaging said seat on at least an end portion of the gate distal to said pivotation mount, blocking said passageway portion, a trough under a portion of said top opening over said lower portion opening, and a sloped surface into which said trough flows water received through said top opening, said sloped surface declining in a direction to flow water away from said lower portion opening.

28. The apparatus of claim 27 comprising a plurality of said sets vertically arranged in said support.

29. The apparatus of claim 28 in which each higher set is horizontally offset from the set next below it and toward said lower portion opening.

30. The apparatus of claim 29 in which the seat of a next lower set is formed on a support portion for the gate of the next higher set distal to the pivotation mount of the gate of such next higher set.

31. A method of preventing downward flow of substantial amounts of surface storm water into an underground ventilation duct communicating upwardly to a surface opening, comprising interposing between said surface opening and said ventilation duct an enclosure upwardly open in fluid communication with said surface opening and opening in a lower portion of said enclosure for venting communication through said enclosure with a proximate portion of said ventilation duct, providing at least one seat and water buoyant gate set in said enclosure, each seat being mounted vertically relative to a portion of a passageway under said seat for fluidly communicating beyond such portion to said top opening and to said proximate portion of said ventilation duct, each said buoyant gate including a pivotation mount and being positioned lower than said seat and said passageway, being normally disposed horizontally, being of sufficient size to block said passageway, and being responsive to water rising in said enclosure by floatingly pivoting upwardly until engaging said seat on at least an end portion of the gate distal to said pivotation mount, blocking said passageway, said enclosure holding water when a gate of a set engages a seat of the set, said enclosure allowing ventilation between said top opening and said ventilation duct so long as rising water in said enclosure has not closed the gate on the seat in every set.

32. The method of claim 31 comprising sheltering said opening in said lower portion of said enclosure from water entering said enclosure through at least the portion of said upwardly open portion of the enclosure over said lower portion thereof.

33. The method of claim 31 comprising directing the flow of water entering said enclosure from said upwardly open portion away from said opening in said lower portion of said enclosure.

34. A method for providing less restrictive airflow through a support structure interposed in a underground ventilation duct system between a ventilation duct and a surface opening of the ventilation duct to prevent downward flow of substantial amounts of surface water into the ventilation duct, said support structure having a top opening for fluid communication with said surface opening, a support floor, and an opening in a lower portion of the support higher than the support floor for fluid communication with a proximate portion of said ventilation duct, said surface opening having a fixed length between selected opposing sides of the opening comprising:

providing in said structure one or more sets each comprising a seat and a paired water buoyant gate normally disposed perpendicular to said seat, arranging each said set in said support to provide airflow from said lower portion opening to said surface opening that is a nominal fraction of the airflow from said ventilation duct to said surface opening absent presence of said apparatus, said fraction having the numerator 1 and a denominator which is the sum of 1 plus the number of said sets, the seat of at least one set being mounted under said top opening spaced from one of said opposing sides a distance nominally equal to said fraction applied to said fixed length, said buoyant gate of a set having a seat engagement height nominally equal to said fraction applied to said fixed length, being positioned lower than said seat, and responsive to water rising in said support by floatingly upwardly until engaging said seat and blocking passage for air flow under said seat.

35. The method of claim 34 in which there are a plurality of spaced vertically arrayed sets, each seat of a set being spaced from one of said opposing sides a distance nominally equal to said fraction applied to said fixed length.

36. The method of claim 34 in which there are a plurality of vertically arrayed sets and in which each higher set is horizontally offset from the set next below it and toward said lower portion opening, the seat of the uppermost set being spaced from one of said opposing sides a distance nominally equal to said fraction applied to said fixed length, and each seat of a next lower set being spaced from one of said opposing sides a distance nominally equal to said fraction applied to said fixed length multiplied by the sum of 1 plus the number of sets above it, said buoyant gate having a seat engagement height nominally equal to said fraction applied to said fixed length for the uppermost set.

37. An apparatus to block flow of substantial amounts of surface water into an ventilation duct communicating from underground to a structure below grade level comprising a floor and an opening at grade level, said apparatus comprising:

a seat support adapted to be secured within said structure below said grade level opening, a seat supported vertically by said seat support, said seat being secured to transect a lower portion of said structure under said grade level opening at a location substantially less restricting airflow between said grade level opening and said ventilation duct, said seat defining within said structure on one side of the seat a portion proximate said ventilation duct and on the other side of the seat a portion distal to said ventilation duct, said seat having an upper inner margin defining a top of an entrance communicating said side proximate said ventilation duct and said side distal to said ventilation duct, a water buoyant gate having a seating surface sized to engage said seat, said buoyant gate being normally horizontally disposed within said structure in said distal portion lower than said entrance and being pivotally movably mounted with respect to said seat, said buoyant gate being responsive to water rising in said structure by floating relatively upwardly for moving said buoyant gate until said buoyant gate engages said seat, whereby said buoyant gate obstructs water entering said structure through said opening from passing through said horizontally oriented entrance.

38. The apparatus of claim 37 in which said seat is located about halfway along the direction of a longest distance in opposing sides of said opening, said seat transecting a lower portion of said structure under said opening perpendicular to the direction of the longest distance, and wherein said buoyant gate has a height not more than about half said longest distance in opposing sides of said opening.

39. The apparatus as claimed in claim 37 in which a portion of a passageway on said side of the spat proximate said ventilation duct ends at said entrance, said apparatus further comprising one or more normally closed pivotally mounted shutters above said proximate passageway portion openable by pressure in said passageway in excess of pressure in said structure above said shutters when said buoyant gate is engaged on said seat blocking said entrance.

40. The apparatus as claimed in claim 39 in which said shelf comprises one or more normally closed pivotally mounted shutters openable by pressure in said horizontally oriented flow passageway in excess of pressure in said structure above said shutters when said buoyant gate is seated on said seat.

41. The apparatus of claim 37 in which said seating surface is in at least an upper periphery of said buoyant gate and is positioned to engage said seat, said buoyant gate including an elevated portion interiorly of said seating surface declining toward said seating surface which engages said seat above said entrance responsive to water rising in said structure, the declination of said elevated portion having a slope effective to direct water entering the structure through said opening away from said entrance when said buoyant gate is in a horizontal position.

42. The apparatus of claim 37 in which said inner margins of said seat surround a horizontal oriented passageway ending in said entrance defined by said margins, said apparatus further comprising one or more normally closed pivotally mounted shutters in a superior position in said passageway openable by pressure in said horizontally oriented passageway in excess of pressure in said structure above said shutters when said buoyant gate is engaged on said seat blocking said entrance.

43. The apparatus of claim 37 in which said apparatus further comprises a horizontal receptacle secured in said lower portion of said structure on said side of said seat distal to said ventilation duct and lower than said entrance, said receptacle having a bottom, said receptacle containing said buoyant gate in a horizontal position above said bottom.

44. The apparatus of claim 43 further wherein said seat support comprises a support frame for pivotingly supporting said moveable buoyant gate.

45. The apparatus of claim 43 wherein said receptacle further comprises a water portal into said receptacle giving access to said bottom of the receptacle when said buoyant gate occupies a horizontal position in the receptacle, said receptacle and buoyant gate being configured to permit water entering through said portal to rise beneath said buoyant gate and buoy said buoyant gate upwardly from the receptacle toward said seat.

46. The apparatus of claim 43 in which said seat is located about halfway along said direction of said longest distance in opposing sides of said opening, and wherein said buoyant gate has a height not more than about half said longest distance in opposing sides of said opening.

47. An apparatus to prevent flow of surface water into an ventilation duct communicating from an underground tunnel to and exiting in a structure below grade level comprising a floor and an opening at grade level, said apparatus comprising:

a support assembly mounted in said structure and having upper and lower extremities, a shelf fastened to said support assembly between said upper and lower extremities and extending horizontally in the direction of the longest distance in opposing sides of said opening, said shelf defining below it a horizontally oriented flow passageway in the structure extending from said exit of said ventilation duct an extent along said direction effective to substantially less restrict airflow between said opening and said ventilation duct, said horizontally oriented flow passageway extending a distance equal to about half the longest distance in opposing sides of said opening, a seat vertically mounted to said support assembly below said shelf around said horizontally oriented flow passageway defining an entrance of the horizontally oriented flow passageway into said portion of the structure beyond the shelf, and a buoyant gate which floats in water, said buoyant gate being pivotally mounted pivoting about an axis perpendicular to the direction of said longest distance and responsive to water rising in said structure by floating relatively upwardly until said buoyant gate engages said seat, said buoyant gate being of sufficient size to block said horizontally oriented passageway and thereby materially prevent water flowing into said structure from passing through said horizontal passageway into said ventilation duct thence into said underground tunnel.

48. A method for blocking flow of surface water into a ventilation duct communicating from an underground tunnel to a structure below grade level comprising a floor and an opening at grade level having a predetermined configuration and a longest distance in opposing sides of the opening, comprising:

providing a seating element around a horizontally oriented passageway extending into said structure in the direction of the longest distance in opposing sides of said opening a distance less substantially restricting airflow between said opening and said ventilation duct;

providing a moveable gate which in an open position permits flow of air between said grade level opening and said vertical duct through said horizontally oriented passageway and in a closed position is engageable with said one or more seating elements to obstruct water entering said structure from said grade level opening from flowing through said horizontally oriented passageway thence into said vertical duct; and providing one or more water buoyancy elements for said gate positioned to operate said moveable gate such that said gate is in said open position when water level in said structure is insufficient to buoy the gate upwardly and is in said closed position when water level in said structure is sufficiently high to buoy it to engage said seating element.

49. The method of claim 48 in which said seating elements are located about halfway along said direction of said longest distance in opposing sides of said opening, and wherein said buoyant gate has a height not more than about half said longest distance in opposing sides of said opening.

50. The method of claim 48 further comprising providing one or more normally closed pivotally mounted shutters above said horizontally oriented passageway openable by air pressure in said passageway in excess of fluid pressure in said structure above said shutters when said gate is in said closed position.

51. The method of claim 48 further comprising providing a seating surface on a periphery of said buoyant gate for engaging said one or more seating elements, said gate including an elevated portion interiorly of periphery, said elevated portion tapering diminishingly toward a seating surface which engages said seat above said horizontally oriented passageway responsive to water rising in said structure, said taper having a slope effective to direct water entering the structure from said grade level opening away from said passageway when said gate is in said open position.

52. Apparatus for preventing downward flow of substantial amounts of surface water into an underground air ventilation duct communicating upwardly to a surface opening, comprising a support adapted to be interposed between said surface opening and said ventilation duct, said support having an upper opening therein in fluid communication with said surface opening and a lower opening therein in fluid communication with said ventilation duct, and one or more seat and gate sets supported by said support, said sets each comprising a seat located between said lower opening and said upper opening and a paired water buoyant gate having a seating surface sized to engage said seat and pivotally mounted lower than said seat to rotate upward toward said seat to engage said seat while maintaining air ventilation between said ventilation duct and said surface opening, if a single seat and gate set, until the single gate engages the single seat, or if more than a single set, until a last to engage of the gates engages its paired seat, said water buoyant gate being responsive to water rising in said support to pivotally rotatingly float upwardly until said gate engages said seat to block passage of water from said surface opening to said lower opening.

53. A method of preventing downward flow of substantial amounts of surface storm water into an underground ventilation duct communicating upwardly to a surface opening, comprising interposing between said surface opening and said ventilation duct support upwardly open in fluid communication with said surface opening and opening in a lower portion for fluid communication with a proximate portion of said ventilation duct, providing one or more seat and gate sets supported by said support, said sets each comprising a seat located between said lower opening and said upper opening and a paired water buoyant gate having a seating surface sized to engage said seat and pivotally mounted lower than said seat to rotate upward toward said seat to engage said seat while maintaining air ventilation between said ventilation duct and said surface opening, if a single seat and gate set, until the single gate engages the single seat, or if more than a single set, until a last to engage of the gates engages its paired seat, said water buoyant gate being responsive to water rising in said support to pivotally rotatingly float upwardly until said gate engages said seat to block passage of water from said surface opening to said lower opening.

* * * * *